US005617096A

United States Patent [19]

Takahashi

[11] Patent Number: 5,617,096

[45] Date of Patent: Apr. 1, 1997

[54] BROAD-BAND RADIO WAVE ABSORBER

[76] Inventor: Michiharu Takahashi, 390-190, Takatsu, Yachiyo-shi, Chiba-ken, Japan

[21] Appl. No.: 327,387

[22] Filed: Oct. 21, 1994

[30] Foreign Application Priority Data

Jul. 25, 1994 [JP] Japan ..... 6-192885

[51] Int. Cl.[6] ..... H01Q 17/00

[52] U.S. Cl. ..... 342/4

[58] Field of Search ..... 333/22 R; 342/1, 342/2, 3, 4

[56] References Cited

U.S. PATENT DOCUMENTS

| | | | |
|---|---|---|---|
| 3,315,259 | 4/1967 | Wesch | 342/4 |
| 3,887,920 | 6/1975 | Wright et al. | 342/1 |
| 4,023,174 | 5/1977 | Wright et al. | 342/4 |
| 4,118,704 | 10/1978 | Ishino et al. | 342/4 |
| 4,701,761 | 10/1987 | Affinito et al. | 342/1 |
| 4,973,963 | 11/1990 | Kurosawa et al. | 342/4 |
| 5,103,231 | 4/1992 | Niioka | 342/1 |
| 5,276,448 | 1/1994 | Naito et al. | 342/4 |
| 5,394,150 | 2/1995 | Naito et al. | 342/4 |

FOREIGN PATENT DOCUMENTS

| | | | |
|---|---|---|---|
| 0439337 | 1/1991 | European Pat. Off. . | |
| 698088 | 11/1979 | U.S.S.R. | 342/4 |
| 776158 | 3/1954 | United Kingdom | 342/4 |
| 795510 | 5/1958 | United Kingdom | 333/22 R |

OTHER PUBLICATIONS

1993 International Symposium on Electromagnetic Compatibility, 9–13 Aug. 1993, pp. 254–259.

*Primary Examiner*—Michael J. Carone
*Attorney, Agent, or Firm*—Lorusso & Loud

[57] ABSTRACT

A broad-band radio wave absorber is disclosed which includes a radio wave reflecting surface, and a plurality of magnetic members provided on the reflecting surface and arranged in columns and rows in the directions of X- and Y-axes, each of the magnetic members having a first section extending in parallel with the Y-axis and a second section in contact with the first section throughout the height thereof and extending in parallel with the X-axis, such that the first sections in each column and the second sections in each row are spaced apart from each other at a predetermined distance. Each of the first and second sections has a part having a length which is smaller than the distance at which each adjacent two sections are spaced apart, so that there is formed an aperture between each of the two adjacent sections.

16 Claims, 30 Drawing Sheets

BROAD-BAND RADIO WAVE ABSORBER

BACKGROUND OF THE INVENTION

This invention relates to a broad-band radio wave absorber useful for constructing anechoic chambers.

An anechoic chamber is now widely used for performing a variety of tests such as for undesirable radiation (noise) from electronics apparatuses, for electromagnetic obstruction, for electromagnetic compatibility and for antenna characteristics. Such an anenchoic chamber is provided with wave absorbers on the inside walls and ceilings thereof.

One known radio wave absorber is shown in FIG. 23 in which designated as M is a conductive metal plate for reflecting a radio wave and as F a sintered ferrite plate in the form of a tile mounted on the metal plate M. In the meantime, when the reflection coefficient at a surface of the wave absorber is represented by "s", the power absorption coefficient thereof is given by $1-|s|^2$. Thus, the smaller the reflection coefficient $|s|$, the better becomes the absorber performance. Generally, an absorber having a reflection coefficient $|s|$ of 0.1 or less is regarded as meeting with the standard. In other words, the standard requires that the return loss (−20 log s) should be 20 dB or more and the power absorption coefficient should be 0.99 or more.

FIG. 24 shows the characteristics of the wave absorber of FIG. 23. In FIG. 24, the abscissa represents frequency f while the ordinate represents reflection coefficient $|s|$. As seen from FIG. 24, the band width B which satisfies the condition $|s| \leqq 0.1$ may be given as follows:

$$B=f_H-f_L \quad (1)$$

wherein $f_L$ and $f_H$ represent the lowest and highest frequencies at which $|s|$ is 0.1, respectively. In the wave absorber shown in FIG. 23, the frequencies $f_L$ and $f_H$ depend upon the ferrite material used. For example, when desired $f_L$ is 30 MHz, sintered ferrite of a NiZn-series or MnZn-series must be used. In this case, $f_H$ is 300–400 MHz. When $f_L$ of 90 MHz is desired, then the ferrite to be used is of a NiZn-series or MnZn-series. In this case, $f_H$ is 350–520 MHz. Since an anechoic chamber requires a wave absorber having $f_L$ of 30 MHz and $f_H$ of 1,000 MHz, the wave absorber of FIG. 23 is not suited therefor. Further, the wave absorber of FIG. 3 is ill-suited for use as an exterior wall material of buildings for the prevention of reflection of TV radio waves, when the required $f_L$ and $f_H$ are 90 MHz and 800 MHz, respectively, like in Japan.

To cope with this problem, there is a proposal in which an air layer (e.g. polyurethane foam layer) is interposed between the ferrite tiles F and the metal plate M in FIG. 23. A wave absorber composed of 7 mm thick NiZn ferrite tiles mounted on the metal plate through an 10 mm thick air layer, for example, shows a return loss of 20 dB or more for a radio wave having a frequency range of 30–800 MHz.

U.S. Pat. No. 5,276,448 discloses a wave absorber of a lattice structure as shown in FIGS. 25(*a*) and 25(*b*). This wave absorber shows a return loss of 20 dB or more for a radio wave of 30–1,000 MHz when a lattice-type ferrite plate F mounted on a metal plate M has a thickness $t_m$ of 7 mm and a height h of 18 mm and, thus, exhibits satisfactory wave absorbing performance. In recent years, an increasing attention has been paid to an importance of electromagnetic immunity of electronic instruments. Because the frequency of radio waves generated from recent electronic instruments widely ranges, there is an increasing demand for wave absorbers having a high $f_H$. In this respect, the above lattice structure-type wave absorber is not satisfactory.

Japanese Unexamined Patent Publication 5-82995 discloses a wave absorber of a superimposed lattice structure as shown in FIGS. 26(*a*) and 26(*b*). This absorber has $f_L$ of 30 MHz and $f_H$ of 3,000 MHz and is effective for a broad band of frequencies. The superimposed lattice structure-type wave absorber, however, has a problem because of difficulty in manufacture. In particular, it is very difficult to prepare the structure, in which the top ferrite has a thickness $t_{m3}$ of less than 1 mm, by molding, due to poor flowability of the powder mass, non-uniformity in molding pressure and poor mold-releasability.

SUMMARY OF THE INVENTION

It is, therefore, an object of the present invention to provide a wave absorber which is effective for a very wide range of frequencies.

Another object of the present invention is to provide a wave absorber of the above-mentioned type which may be produced in an economically acceptable manner.

It is a further object of the present invention to provide a wave absorber whose height in the direction of the incident wave is relatively small.

It is yet a further object of the present invention to provide a wave absorber exhibiting desirably controlled absorbing characteristics.

In accomplishing the foregoing objects, there is provided in accordance with one aspect of the present invention a broad-band radio wave absorber comprising a radio wave reflecting surface, and a plurality of magnetic members provided on said reflecting surface and arranged in columns and rows in the directions of the X- and Y-axes, respectively, each of said magnetic members including a first section extending in parallel with the Y-axis and a second section in contact with said first section throughout the height thereof and extending in parallel with the X-axis, such that said first sections of respective magnetic members in each row are aligned and said second sections of respective magnetic members in each column are aligned and that said first sections in each column are spaced apart from each other at a distance $P_x$ and said second sections in each row are spaced apart from each other at a distance $P_y$, each of said first sections having a part with a length along the Y-axis of $L_y$ and a thickness along the X-axis of $T_x$, each of said second sections having a part with a length along the X-axis of $L_x$ and a thickness along the Y-axis of $T_y$, wherein $L_y$, $P_y$, $T_y$, $L_x$, $P_x$ and $T_x$ meet with the following conditions:

$$T_y<L_y<P_y \text{ and}$$

$$T_x<L_x<P_x.$$

In another aspect, the present invention provides a broad-band radio wave absorber comprising a radio wave reflecting surface, a magnetic plate provided on said reflecting surface, and a plurality of magnetic members provided on said magnetic plate and arranged in columns and rows in the directions of the X- and Y-axes, respectively, each of said magnetic members including a first section extending in parallel with the Y-axis and a second section in contact with and extending from said first section in parallel with the X-axis, such that said first sections of respective magnetic members in each row are aligned and said second sections of respective magnetic members in each column are aligned and that said first sections in respective rows are spaced apart from each other at a distance $P_x$ and said second sections in respective columns are spaced apart from each other at a distance $P_y$, wherein each of said first sections has a length along the Y-axis of $L_y$ which is smaller than said distance $P_y$ and each of said second sections has a length along the X-axis of $L_x$ which is smaller than said distance $P_x$.

The present invention also provides a broad-band radio wave absorber comprising a radio wave reflecting surface, and a plurality of magnetic members provided on said reflecting surface and arranged in columns and rows in the directions of the X- and Y-axes, respectively, each of said magnetic members having a plurality of portions superimposed in turn in a stepwise manner and each having a square cross-section on the X-Y plane with opposing sides of said square being oriented in the direction parallel with the X- or Y-axis, wherein the cross-sectional area on the X-Y plane in each of said portions decreases from the lowermost portion toward the uppermost portion of each of said magnetic members, wherein the axes of said rows are spaced apart at an equidistance from each other by a distance D and the axes of said columns are spaced apart at an equidistance from each other by said distance D, and wherein the lowermost portion of each of said magnetic members has a width which is equal to said distance D.

A superimposed multi-layered wave absorber may be regarded as being equivalent to a structure as conceptually illustrated in FIG. 27 in which a plurality (n-number) of media (radio wave absorbing layers) having different electrical constants are superimposed in the direction parallel with the direction of an incident radio wave. In FIG. 27, $d_n$ represents a height of the medium "n" having a specific magnetic permeability $\mu_{rn}$ and a specific dielectric constant $\epsilon_{rn}$.

The characteristic impedance Zc and the propagation constant $\gamma$ of a medium having a relative magnetic permeability $\mu r$ and a relative dielectric constant $\epsilon_r$ may be shown by the following formulas (2) and (3):

$$Zc=\sqrt{(\mu/\epsilon)}=\sqrt{(\mu_0/\epsilon_0)}\sqrt{(\mu_r/\epsilon_r)} \quad (2)$$

$$\gamma=j\omega\sqrt{(\mu\epsilon)}=j\omega\sqrt{(\mu_0\mu_r\epsilon_0\epsilon_r)} \quad (3)$$

wherein $\mu_0$ and $\epsilon_0$ represent the permeability and dielectric constant, respectively, of air and $\omega$ represents an angular frequency. The input impedance $Zd_n$ at the incident plane a—a' through which a plane wave is introduced in the direction normal to the plane a—a' toward the reflecting surface of the superimposed multi-layered wave absorber may be shown by the formula (4):

$$zd_n=Zc_m\cdot(Zd_{n-1}+Zc_n \tan h\gamma_n d_n)/Zc_n+Zd_{n-1} \tan h\gamma_n d_n) \quad (4)$$

wherein $Zc_n$ represents a characteristic impedance of the medium n as given by the formula (2), $Zd_{n-1}$ represents the impedance at the plane b—b' through which the wave is introduced into the medium (n−1) toward the reflecting surface and $\gamma_n$ represents a propagation constant of the medium n as given by the formula (3). The formula (3) is the same as a formula which is well known in the electric engineering as representing a system in which a multiplicity of transmission lines having a characteristic impedance Zc and a propagation constant $\gamma$ are connected.

FIGS. 28(*a*)–28(*c*) conceptually illustrate lattice structures having one, two and three layers, respectively, each having alternately arranged magnetic members and gaps. In these Figures, pairs of upper and lower horizontal lines define a transmission line having a width B, $Zd_1$–$Zd_3$ each represent an input impedance at the plane a—a', b—b' and c—c', respectively, $d_1$–$d_3$ represent heights of respective layers, M represents a wave reflecting surface, $t_{m1}$–$t_{m3}$ represents the thicknesses of respective members, $\gamma_1$–$\gamma_3$ represent propagation constants of respective layers, and $Zc_1$–$Zc_3$ represent characteristic impedances of respective layers.

Generally, the relative magnetic permeability $\mu_r$ and the relative dielectric constant $\epsilon_r$ of a magnetic substance may be represented by the following formulas each containing a complex:

$$\mu_r=\mu_{r1}-j\mu_{r2} \quad (5)$$

$$\epsilon_r=\epsilon_{r1}-j\epsilon_{r2} \quad (6)$$

For example, the relative permeability $\mu_r$ of sintered ferrite of a NiZn type is generally such that the real part $\mu_{r1}$ is in the range of about 10–2,500 when the frequency is as low as 1 KHz while the imaginary part $j\mu_{r2}$ is generally proportional to $\mu_{r1}$. On the other hand, the relative dielectric constant $\epsilon_r$ of the above ferrite is such that the real part $\epsilon_{r1}$ is in the range of 12–15 and is independent from the frequency while the imaginary part $j\epsilon_{r2}$ is extremely small. In the following description, the terms "relative permeability" and "relative dielectric constant" are intended to refer to $\mu_{r1}$ and $\epsilon_{r1}$, respectively, at the frequency of 1 KHz except otherwise specifically noted.

A layer in which both ferrite and gap (air) are present may be regarded, as a whole, as being equivalent to a hypothetical layer which is uniformly filled with a medium having a relative permeability and a relative dielectric constant which differ from those of the ferrite. Such a relative dielectric constant and a relative permeability of the hypothetical layer are herein referred to as being apparent ones. The apparent relative dielectric constant and apparent relative permeability of a layer vary with a relative size of the gap, as will be appreciated from the following description taken in conjunction with FIG. 29.

Referring to FIG. 29, designated as L, L are a pair of flat, horizontal, conductive plates spaced apart from each other at a distance b. A pair of rectangular parallelepiped ferrite bodies F, F each having a height h and a thickness $t_m$ are disposed between the plates L, L. When $t_m$ is 0.5 b, the apparent relative permeability and apparent relative dielectric constant are maximum. As the thickness $t_m$ decreases, these values decrease.

For example, when the ferrite has a relative permeability of 2,500 and a relative dielectric constant of 15, the above structure gives an apparent relative permeability of 2,500 and an apparent relative dielectric constant of 15 if $t_m$ is 0.5 b. On the other hand, when $t_m$ is zero, then the apparent relative permeability is 1.0 and the apparent relative dielectric constant is 1.0. When b is 20 mm and $t_m$ is 3 mm, i.e. when a gap of 14 mm exists, the apparent permeability and the apparent dielectric constant are 750 and 5.5, respectively. The above values are obtained under such conditions that the direction of the magnetic field is from the backside to the front side of the paper and that the distance b is sufficiently small as compared with the wave length.

In the above-mentioned superimposed lattice-type wave absorber shown in FIGS. 26(*a*) and 26(*b*), the relative dielectric constant in each layer is adjusted to a desired value by the adjustment of the thickness of the ferrite. For example, in the three-layered structure in which NiZn ferrite having a relative permeability of 2,500 and a relative dielectric constant of 15 is used and the distance b is 20 mm, the apparent relative permeability and apparent dielectric constant of the first, lower layer are 2,100 and 13.5, respectively, when the height $h_1$ is 4 mm and the thickness $t_{m1}$ is 8.5 mm. In the second, intermediate layer having a height $h_2$ of 25 mm and a thickness $t_{m2}$ of 0.6 mm, the apparent relative permeability and apparent dielectric constant are 151 and 2.0, respectively. In the third, upper layer having a height $h_3$ of 27 mm and a thickness $t_{m3}$ of 0.2 mm, the apparent relative permeability and apparent dielectric constant are 51 and 1.3, respectively. This structure shows a return loss of 20 dB or more for a wide range of radio wave frequency of 30–3,000 MHz but encounters the previously described problems, i.e. difficulties in preparation.

In the present invention, an aperture is defined between two portions of each adjacent two magnetic members. By this expedient, the wall thickness of each magnetic member can be increased and, hence, no difficulties are caused during the manufacture of the wave absorber. Moreover, the wave absorber is effective for a wider range of frequencies as compared with known superimposed lattice-type wave absorbers.

FIG. 30(*a*) schematically illustrates an arrangement of two continuously juxtaposed magnetic members each having a crosswise shape as seen in the direction of the incident radio wave, whereas FIG. 30(*b*) illustrates an arrangement in which an aperture S is formed between adjacent two magnetic members. When the magnetic member of FIG. 30(*a*) is formed of a ferrite having a relative permeability of 2,500 and has a thickness $t_m$ of 3.3 mm and a distance b between two magnetic members of 20 mm, the frequency dependency of the apparent relative permeability of the structure is as shown in FIG. 31. On the other hand, FIG. 32 illustrates frequency dependency of the apparent relative permeability of the structure shown in FIG. 30(*b*) in which the length L is decreased to 14 mm (an aperture of 7 mm is formed) while the thickness $t_m$ and distance b remain unchanged. As seen from FIGS. 31 and 32, the formation of an aperture results in a great change in variation of relative permeability by frequency.

In the present specification, the characteristics of wave absorbers are measured with a tri-plate transmission line as shown in FIGS. 33(*a*) and 33(*b*) using a TEM wave. In FIGS. 33(*a*) and 33(*b*), designated as 110 is a sample to be measured, as 111 an input connector, as 112 an outer flat plate made of a conductive material, as 113 an inner flat plate made of a conductive material, and as 114 is a radio wave reflecting plate made of a metal.

BRIEF DESCRIPTION OF THE DRAWINGS

Other objects, features and advantages of the present invention will become apparent from the detailed description of the preferred embodiments of the invention which follows, when considered in light of the accompanying drawings, in which:

FIG. 2(*b*) is a plan view of the magnetic member of FIG. 2(*a*);

FIG. 2(*c*) is an elevational view of the magnetic member of FIG. 2(*a*);

FIG. 5(*b*) is a plan view of the magnetic member of FIG. 5(*a*);

FIG. 5(*c*) is an elevational view of the magnetic member of FIG. 5(*a*);

FIG. 8(*b*) is a plan view of the magnetic member of FIG. 8(*a*);

FIG. 11(*b*) is a plan view of the magnetic member of FIG. 11(*a*);

FIG. 14(*b*) is an elevational view of the magnetic member of FIG. 14(*a*);

FIG. 25(*b*) is an enlarged fragmentary view of the wave absorber of FIG. 25(*a*);

FIG. 26(*b*) is an enlarged fragmentary view of the wave absorber of FIG. 26(*a*);

FIG. 30(*b*) is plan view of two juxtaposed magnetic members with a space being defined therebetween;

DETAILED DESCRIPTION OF THE PREFERRED EMBODIMENTS OF THE INVENTION

Figure 1:
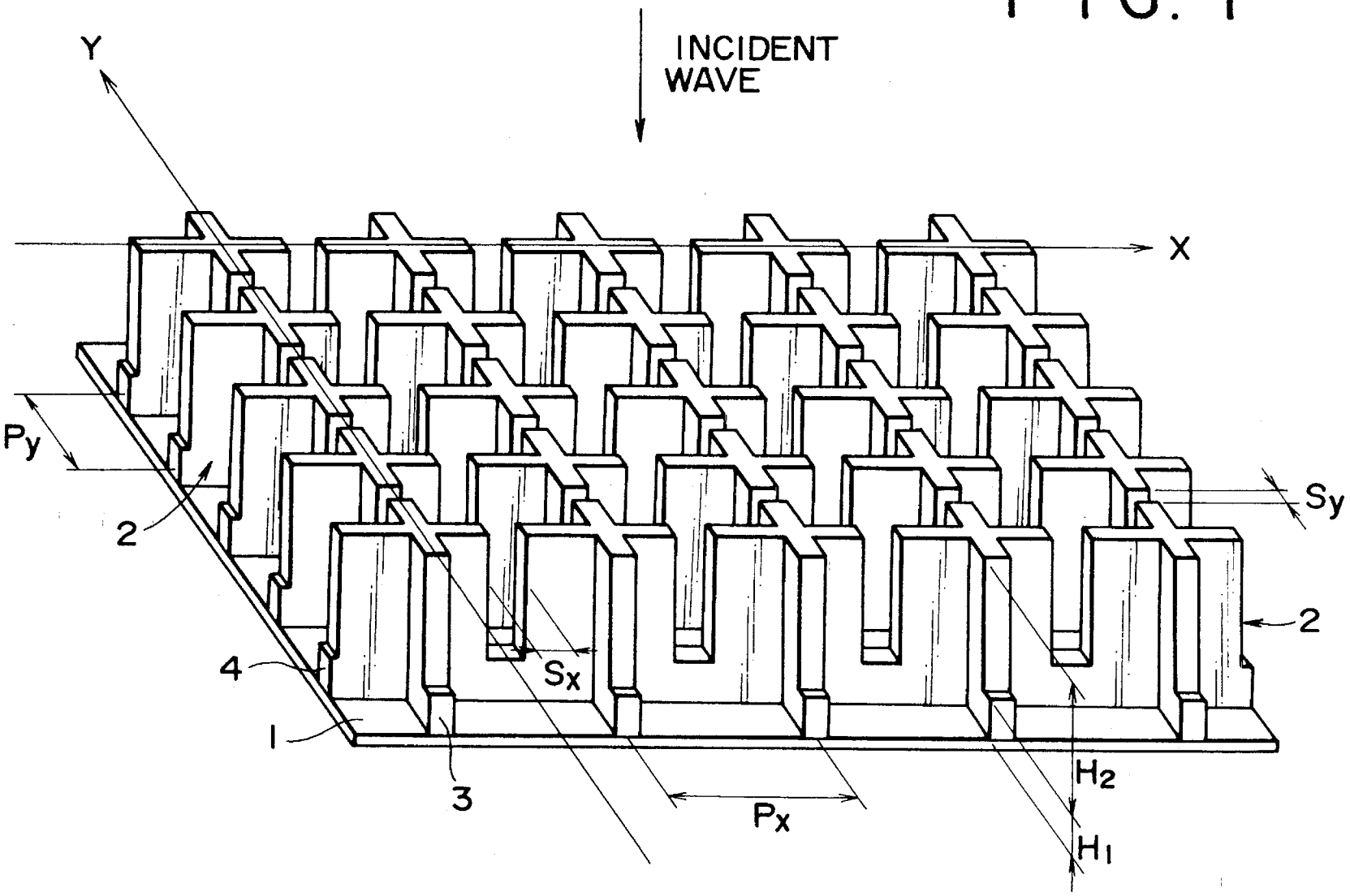
FIG. 1 is a perspective view showing one embodiment of a radio wave absorber according to the present invention.

Referring to FIG. 1, a broad-band radio wave absorber according to the present invention includes a radio wave reflecting surface 1, generally a conductive metal plate, and a plurality of magnetic members 2 fixedly attached to the reflecting surface 1 and arranged in columns and rows in the directions of the X- and Y-axes, respectively. Each of the magnetic members 2 is preferably uniformly formed of a ferrite-containing material such as sintered ferrite of NiZn-series or "rubber ferrite" containing ferrite powder dispersed in a matrix of a chloroprene rubber or a polyolefin or the like plastic material.

Figure 2A:
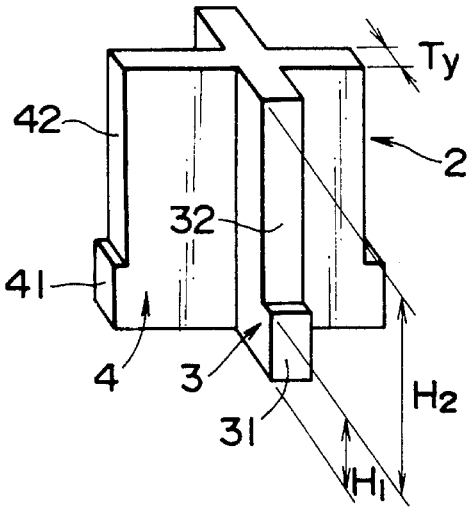
FIG. 2(*a*) is a perspective view showing a magnetic member of the embodiment of FIG. 1.
Figure 2B:
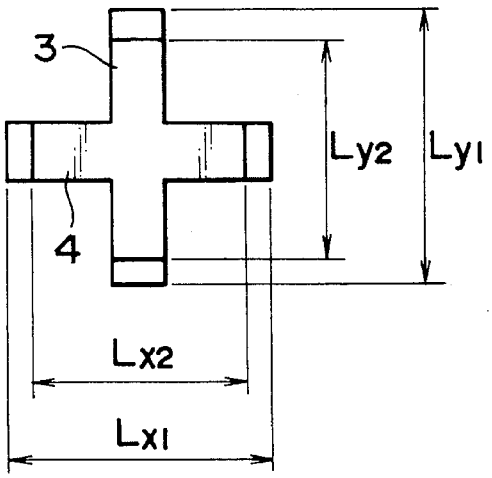
Figure 2C:
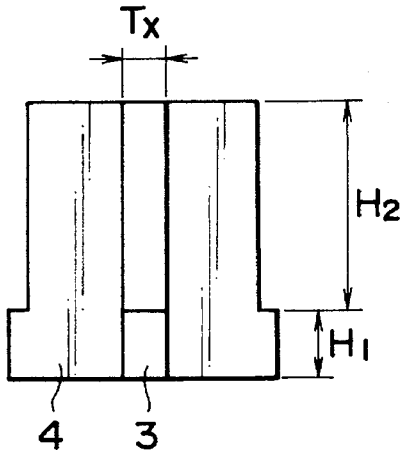

As shown in FIGS. 2(*a*)–2(*c*), each of the magnetic members 2 has a first section 3 extending in parallel with the Y-axis and a second section 4 in contact with the first section 3 throughout the height thereof and extending in parallel with the X-axis. As seen from FIG. 1, the first sections 3 of respective magnetic members 2 in each row are aligned and the second sections 4 of respective magnetic members 2 in each column are aligned. The first sections 3 in each column are spaced apart at a distance $P_x$ while the second sections 4 in each row are spaced apart at a distance $P_y$. In other words, the distance between two adjacent rows is $P_x$ while the distance between two adjacent columns is $P_y$.

Figure 22A:
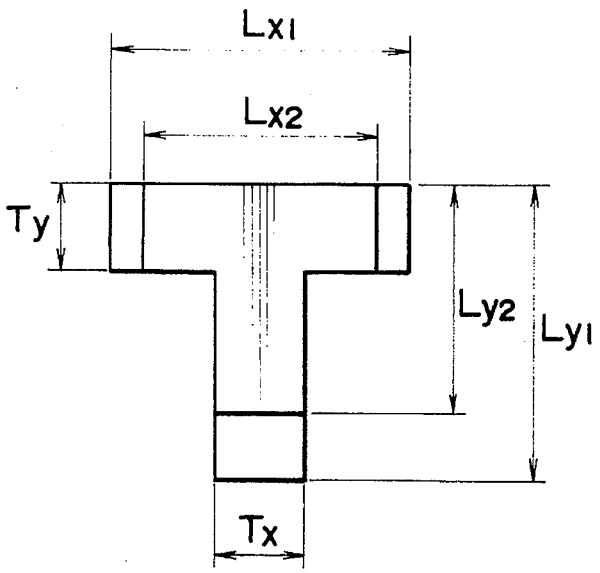
FIGS. 22(*a*) and 22(*b*) are plan views, similar to FIG. 2(*b*), showing examples of the shapes of the magnetic members of still further embodiments in accordance with the invention.
Figure 22B:
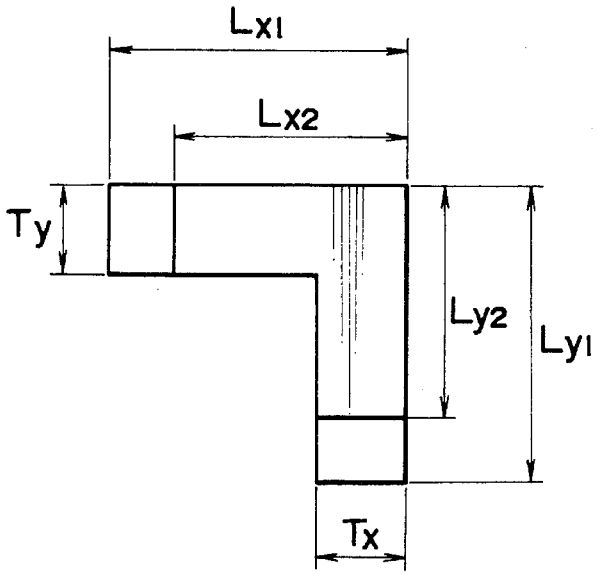
Figure 23:
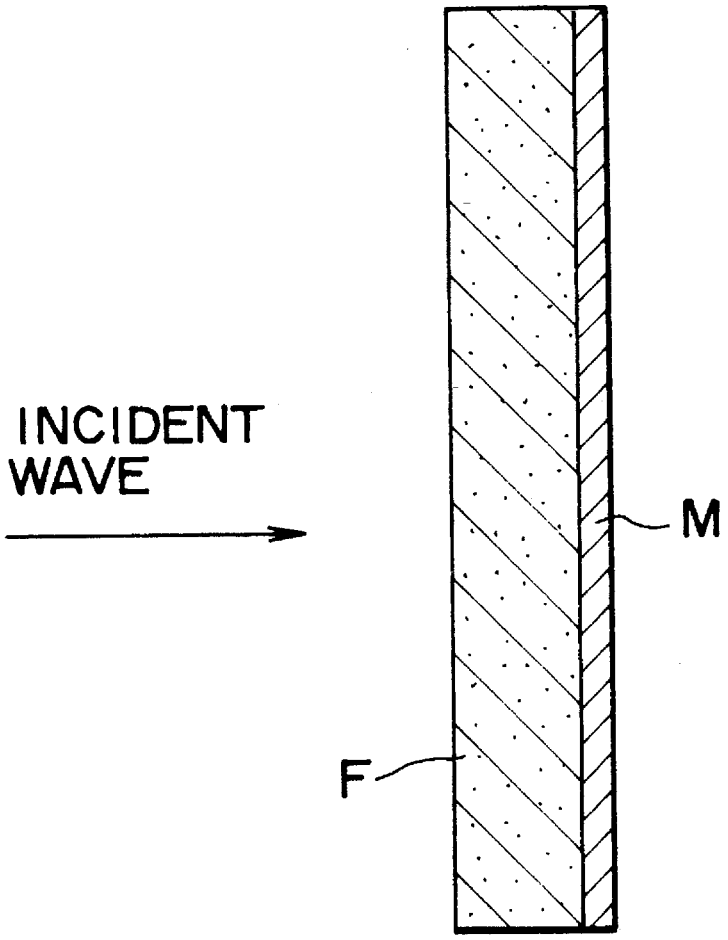
FIG. 23 PRIOR ART
FIG. 23 is a sectional view showing a known wave absorber having a tile-like structure.
Figure 24:
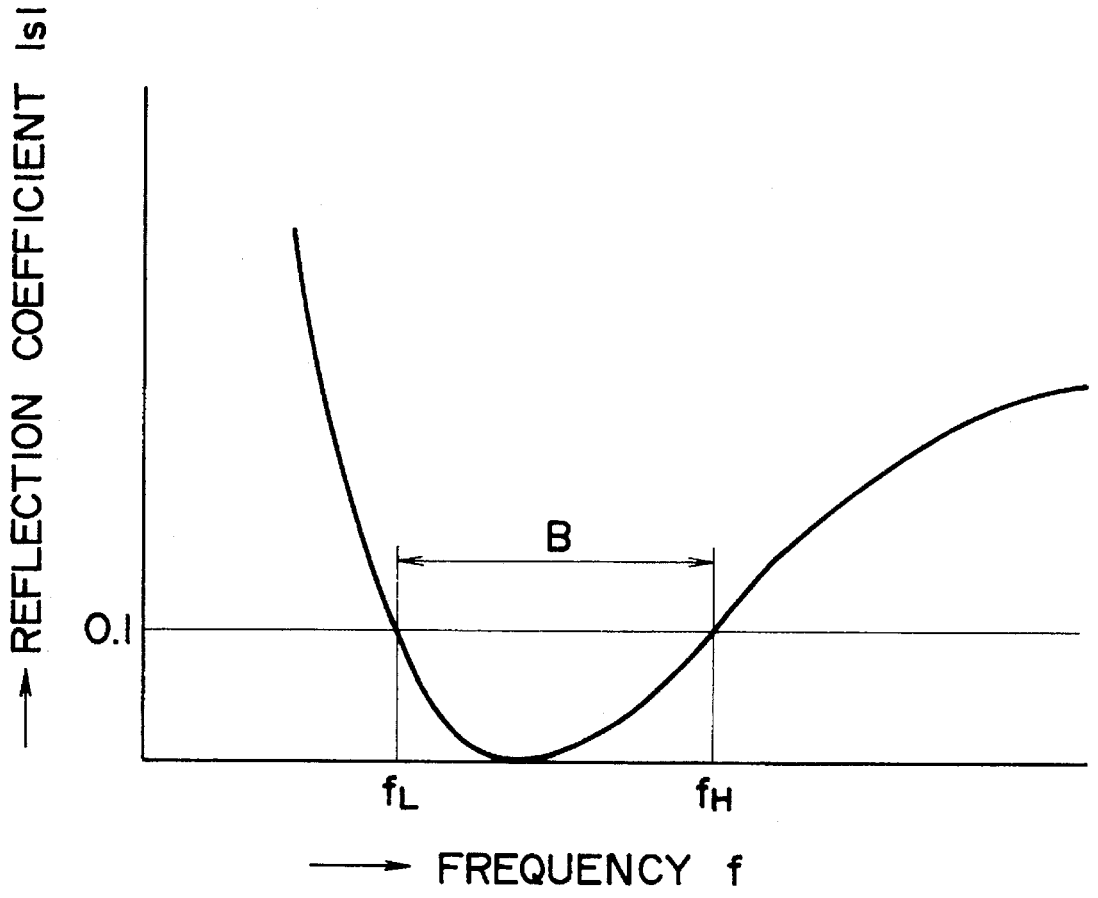
FIG. 24 is a graph showing radio wave absorbing characteristics of the radio wave absorber of FIG. 23.
Figure 25A:
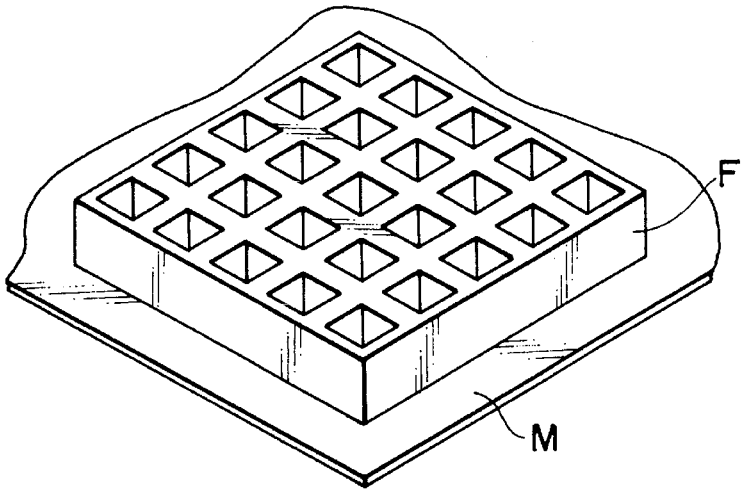
FIG. 25(a) PRIOR ART
FIG. 25(*a*) is a fragmentary perspective view showing a known wave absorber having a lattice-like structure.
Figure 25B:
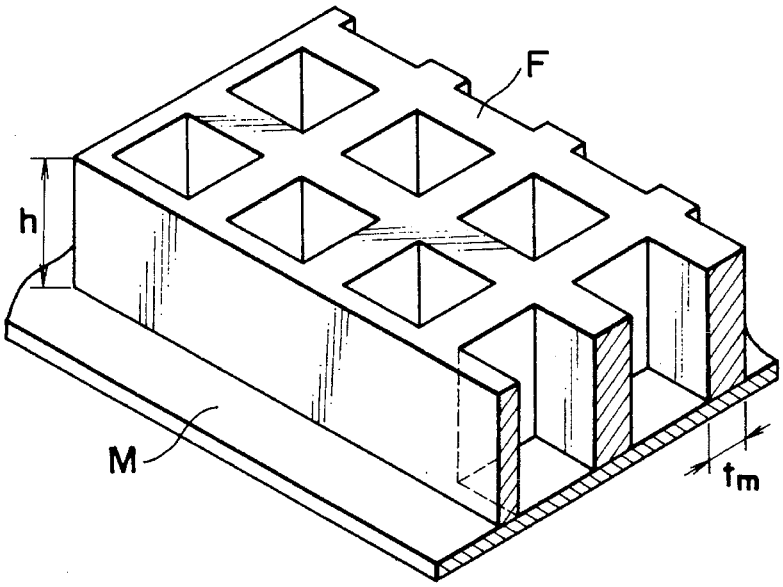
FIG. 25(b) PRIOR ART
Figure 26A:
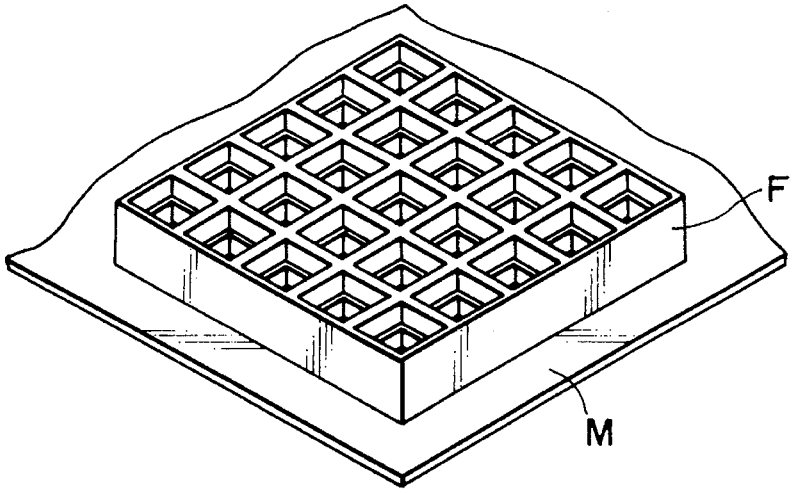
FIG. 26(a) PRIOR ART
FIG. 26(*a*) is a fragmentary perspective view showing a known wave absorber having a superimposed, lattice-like structure.
Figure 26B:
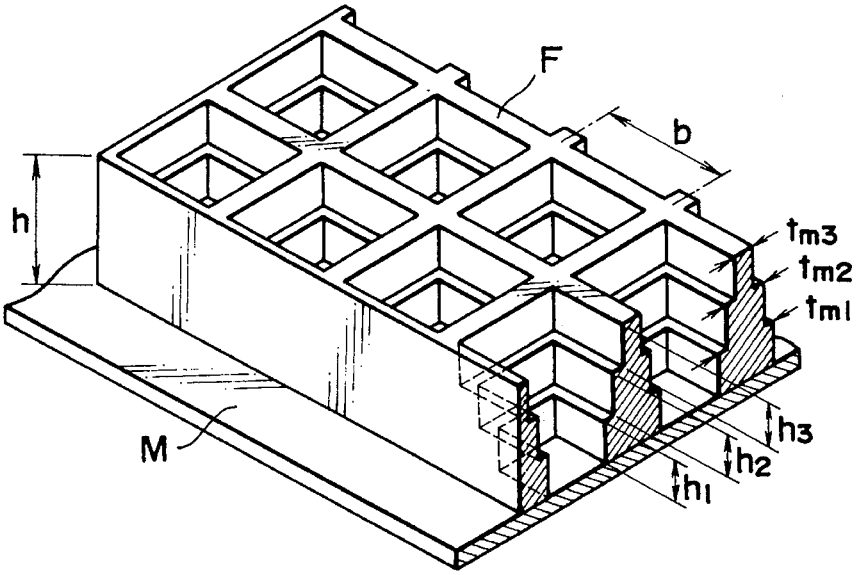
FIG. 26(b) PRIOR ART
Figure 27:
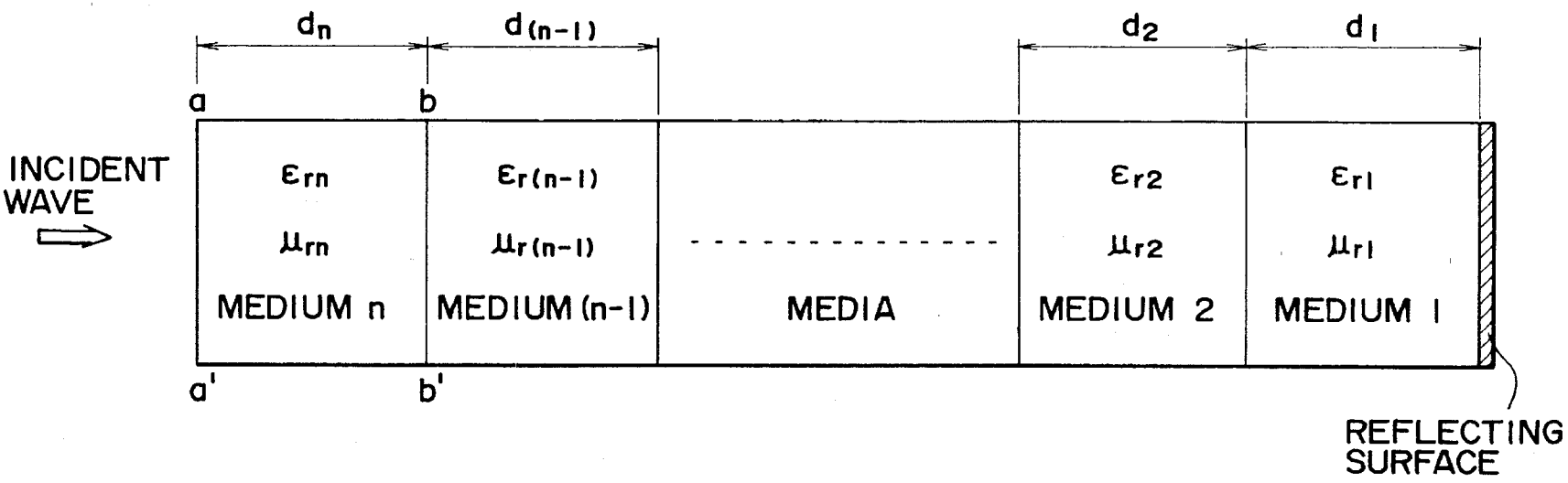
FIG. 27 is a conceptual view of a superimposed multi-layered wave absorber.
Figure 28A:
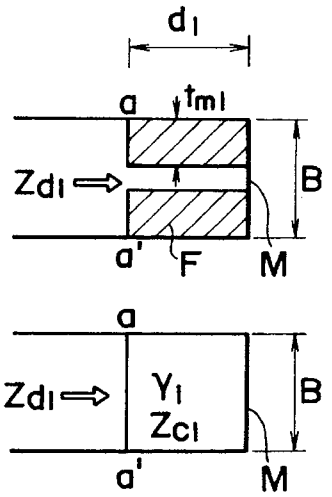
FIGS. 28(*a*)–28(*c*) conceptually illustrate lattice structures having one, two and three layers, respectively, each having alternately arranged magnetic members and gaps.
Figure 28B:
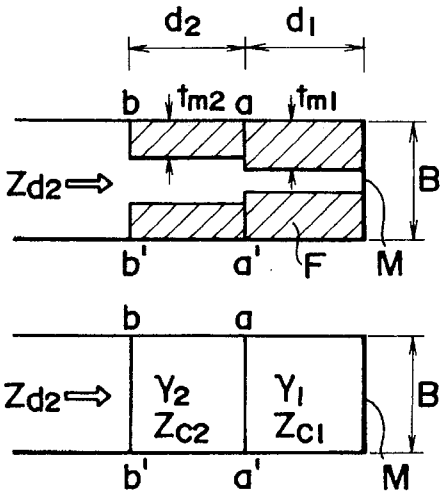
Figure 28C:
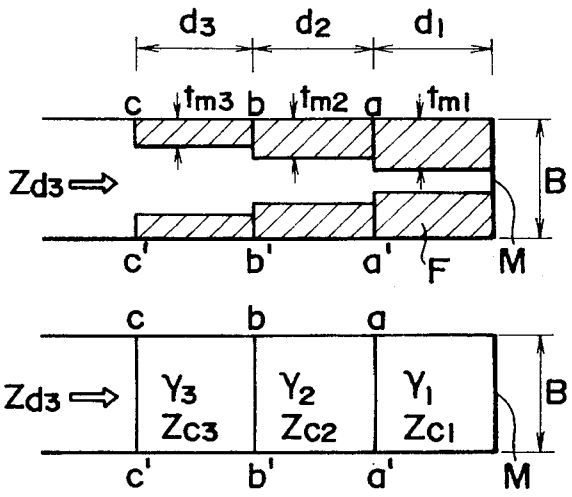
Figure 29:
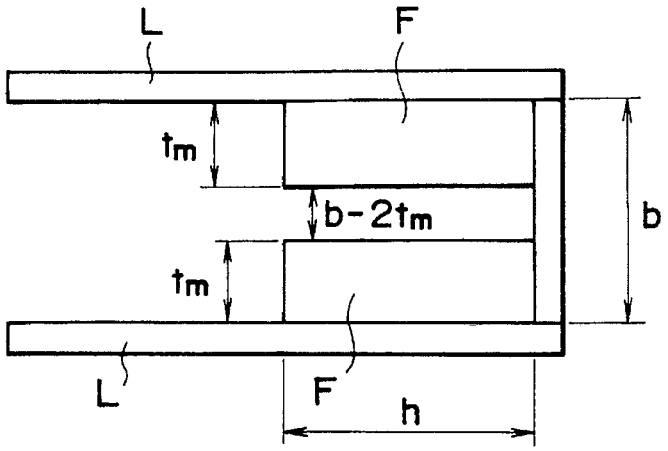
FIG. 29 is an illustration for explaining variation of electromagnetic constants by a size of a gap.
Figure 30A:
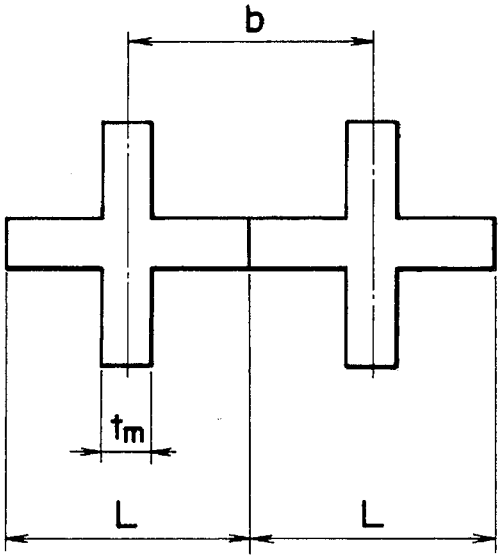
FIG. 30(*a*) is a plan view of two continuously juxtaposed magnetic members.
Figure 30B:
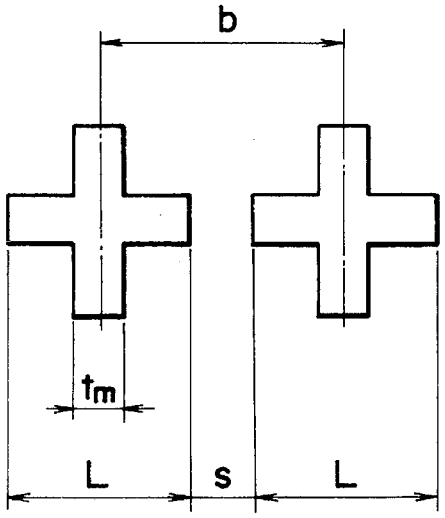
Figure 31:
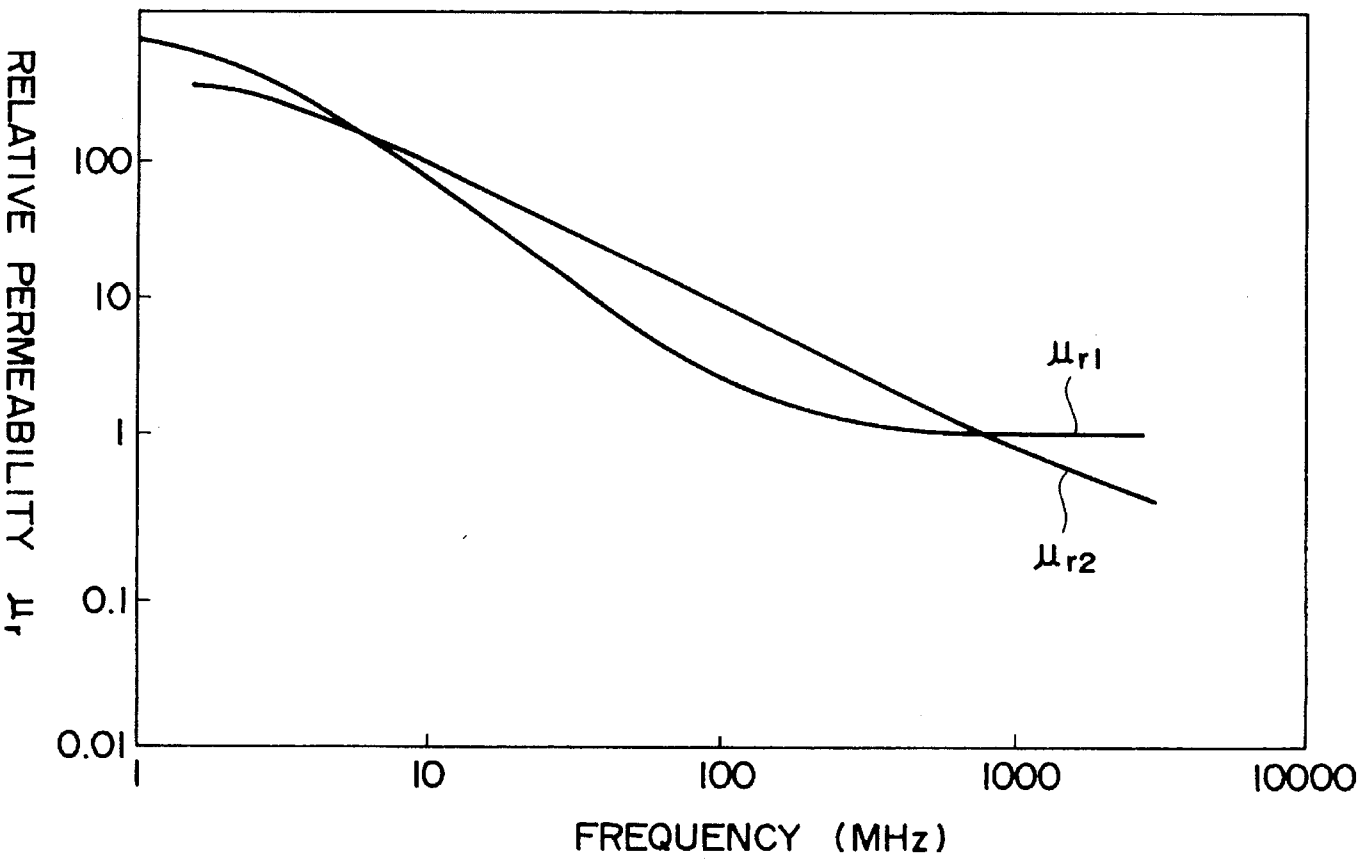
FIG. 31 is a graph showing frequency dependency of the apparent relative permeability of the structures of FIGS. 30(*a*) and 30 (*b*)
Figure 32:
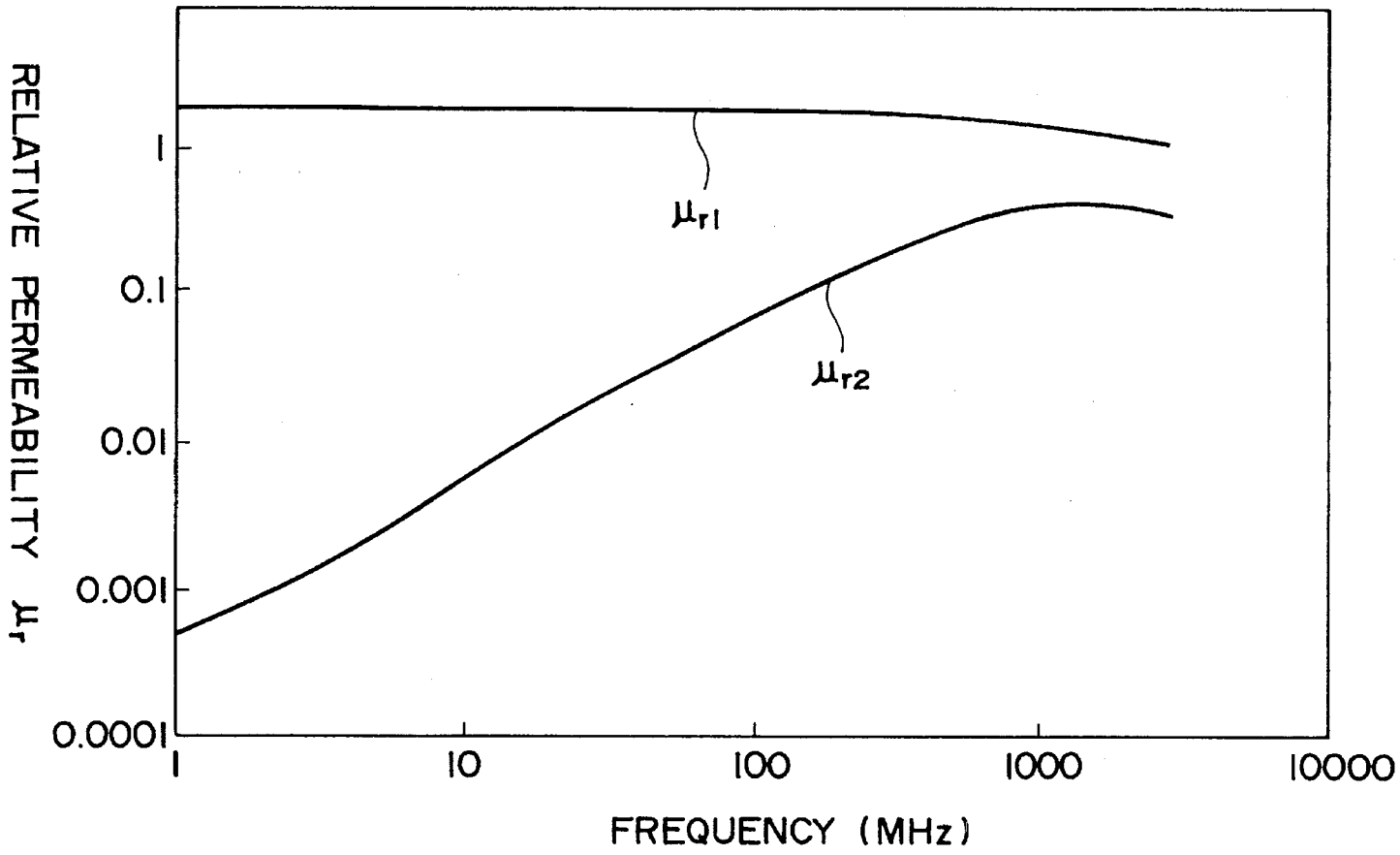
FIG. 32 is a graph showing frequency dependency of the apparent relative permeability of the structures of FIGS. 30(*a*) and 30(*b*)
Figure 33B:
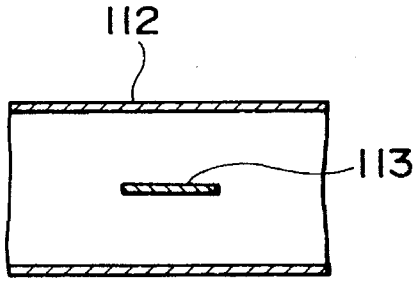
FIGS. 33(*a*) and 33(*b*) are vertical and horizontal cross-sectional views diagrammatically showing a tri-plate transmission line for measuring the characteristics of wave absorbers.
Figure 33A:
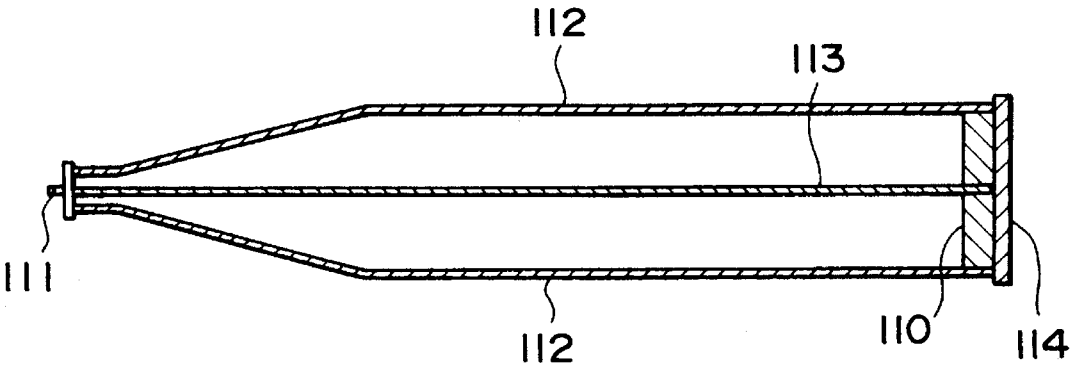

In the embodiment shown in FIG. 1, the first and second sections 3 and 4 of each of the magnetic members 2 are arranged in a crossway manner. However, as shown in FIGS. 22(*a*) and 22(*b*), the magnetic member 2 may be in any desired shape, such as a T-shaped or L-shaped form, as viewed in the direction of the incident radio wave, as long as the first and second sections 3 and 4 are in contact with each other and oriented perpendicularly to each other.

Each of the second sections 4 has a portion 42 having a length along the X-axis of $L_{x2}$ which is smaller than the distance $P_x$ and a thickness along the Y-axis of $T_y$, while each of the first sections 3 has a portion 32 having a length along the Y-axis of $L_{y2}$ which is smaller than the distance $P_y$ but which is greater than the thickness $T_y$ and a thickness along the X-axis of $T_x$ which is smaller than the length $L_{x2}$. Namely, $L_y$, $P_y$, $T_y$, $L_x$, $P_x$ and $T_x$ meet with the following conditions:

$$T_y<L_y<P_y \text{ and}$$

$$T_x<L_x<P_x.$$

As a consequence, there is formed an aperture of a length $S_x$ between each adjacent two magnetic members 2 arranged in the direction parallel with the X-axis. Similarly, an aperture of a length $S_y$ is formed between each adjacent two magnetic members arranged in the direction parallel with the Y-axis.

In the specific embodiment shown in FIG. 1, each of the first and second sections 3 and 4 has a first, lower portion (31, 41) on which the second, upper portion (32, 42) is superimposed in a stepwise manner. The lower portion 31 of each of the first sections 3 has a length $L_{y1}$ equal to the distance $P_y$ while the lower portion 41 of each of the second sections 4 has a length $L_{x1}$ equal to the distance $P_x$, so that the lower portions 31 and 41 of one magnetic member 2 are continuous with those of the adjacent magnetic members 2. The present invention, however, is not limited to the specific embodiment shown in FIG. 1 only. The lengths $L_x$ and $L_y$ of the first and second sections 3 and 4 may be changed continuously rather than stepwisely. Further, it is not essential that the lengths $L_x$ and $L_y$ of the first and second sections 3 and 4 should continuously or stepwisely decrease from the bottom toward the top thereof.

It is, however, preferred that each of the first and second sections 3 and 4 be composed of a plurality of, more preferably two, portions superimposed in turn in a stepwise manner. In this case, it is also preferred that the length of each portion become smaller from the bottom towards the top thereof. Preferably, each of the magnetic members 2 is integrally prepared by molding to have a unitary structure.

Figure 3:
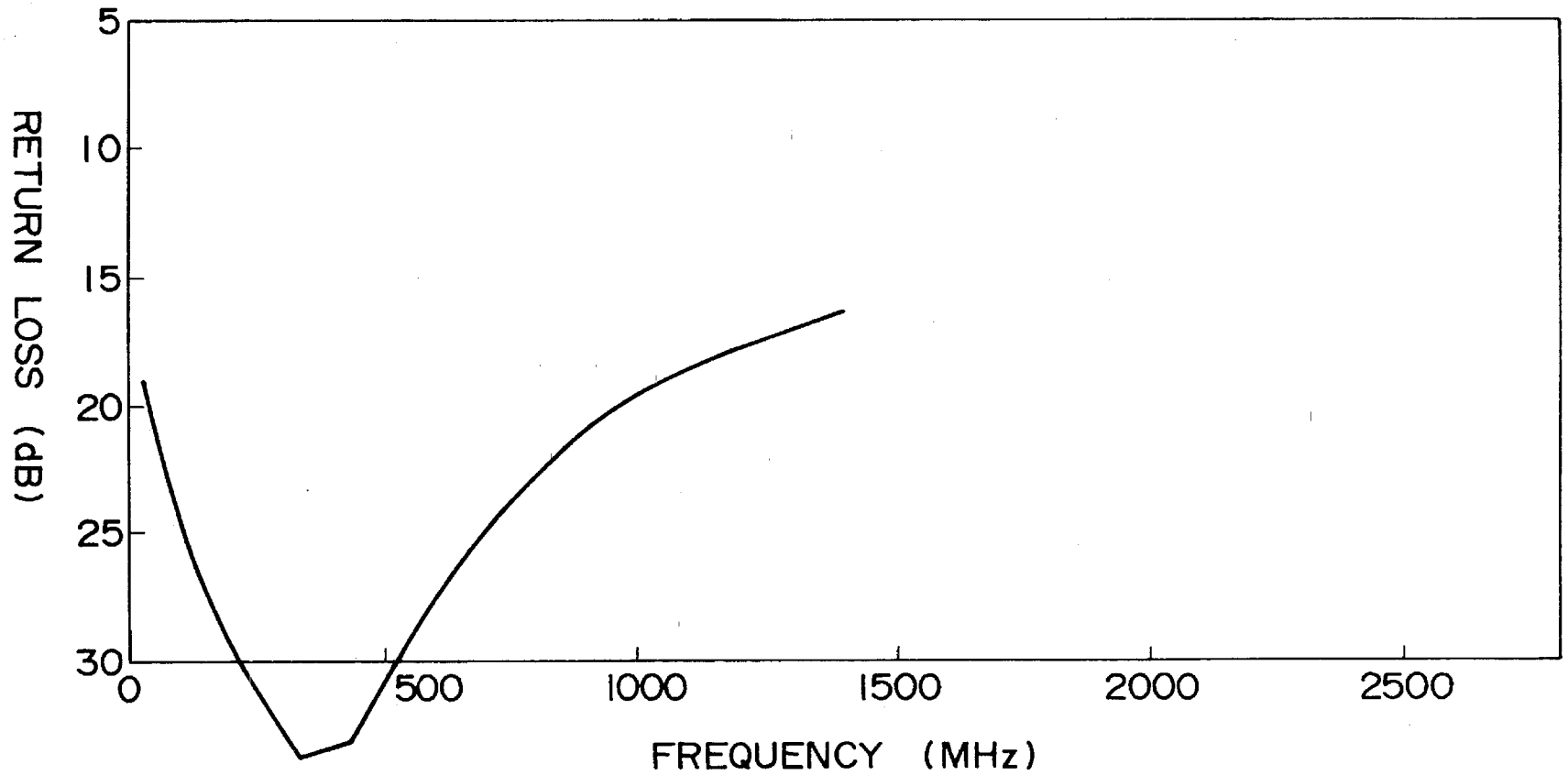
FIG. 3 is a graph showing radio wave absorbing characteristics of the radio wave absorber of FIG. 1.

When each of the magnetic members 2 shown in FIG. 1 is constructed as summarized below, the absorption characteristics of the wave absorber is as shown in FIG. 3. It will be appreciated that the wave absorber shows a return loss of 20 dB or more for a radio wave frequency in the range of 30–1,000 MHz.

Material of magnetic member: NiZn sintered ferrite

Relative permeability of ferrite: 2,500

Distance between magnetic members ($P_x$, $P_y$): 20 mm

Lower layer:

First portion (31, 41):

Length $L_{x1}$, $L_{y1}$: 20 mm

Thickness $T_x$, $T_y$: 8 mm

Height $H_1$: 14.5 mm

Apparent relative permeability: about 1,000

Apparent relative dielectric constant: about 7

Upper layer:

Second portion (32, 42):

Length $L_{x2}$, $L_{y2}$: 13 mm

Thickness $T_x$, $T_y$: 8 mm

Height $H_2$: 22 mm

Aperture $S_x$, $S_y$: 7 mm

Apparent relative permeability: about 2

Apparent relative dielectric constant: about 1.8

Figure 4:
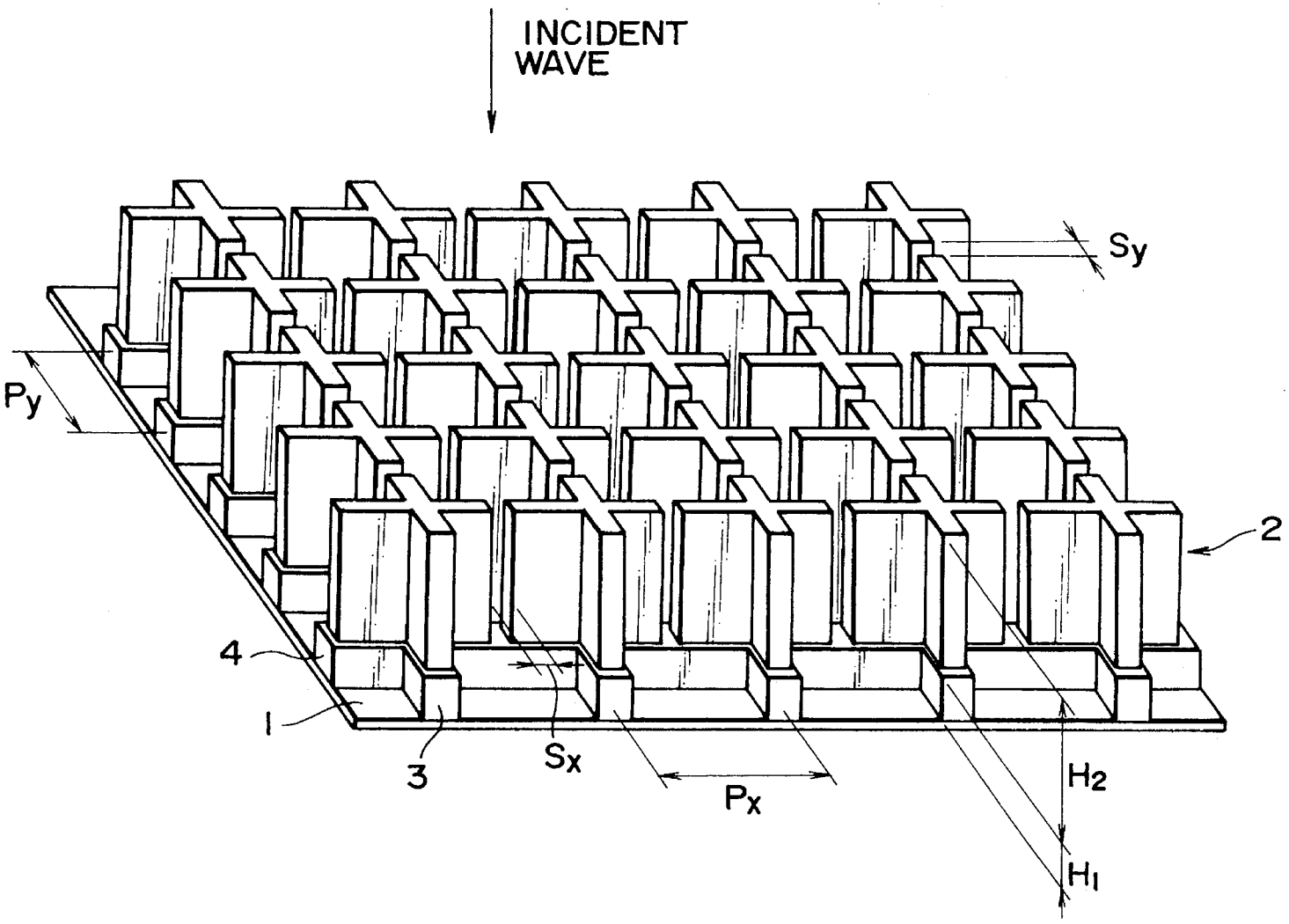
FIG. 4 is a perspective view showing another embodiment of a radio wave absorber according to the present invention.
Figure 5A:
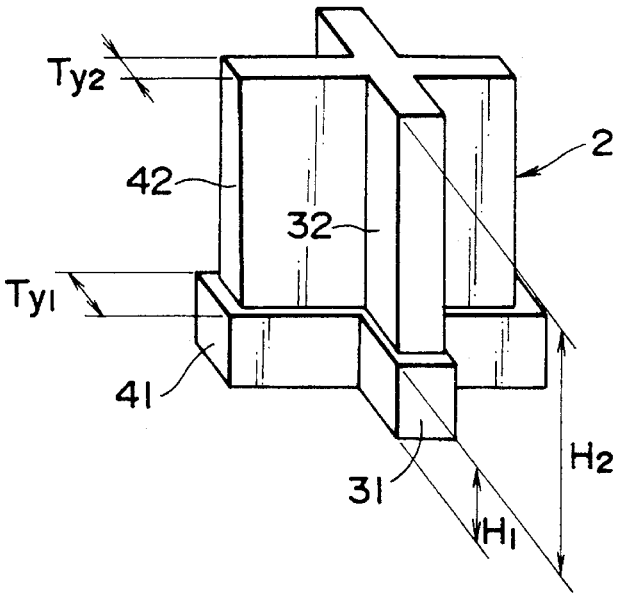
FIG. 5(*a*) is a perspective view showing a magnetic member of the embodiment of FIG. 4.
Figure 5B:
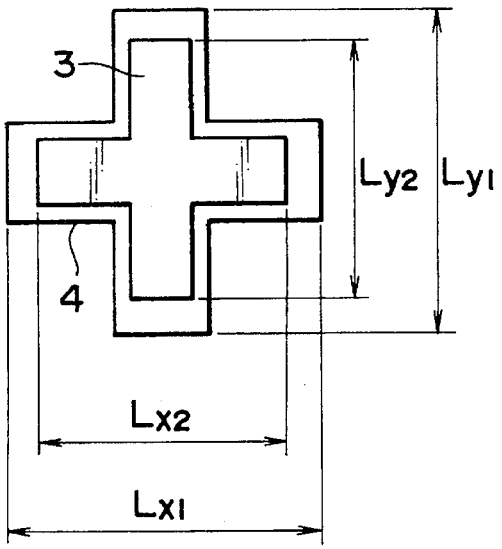
Figure 5C:
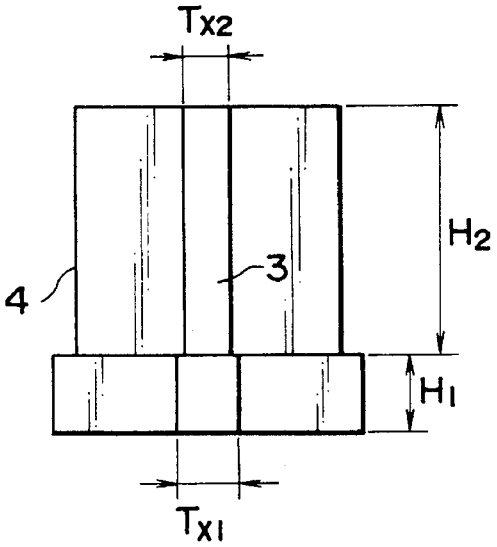

FIGS. 4 and 5(*a*)–5(*c*) depict an embodiment similar to that of FIG. 1 except that the upper, second portion 32 of the first section 3 has a thickness $T_{x2}$ which is smaller than the thickness $T_{x1}$ of the first portion 31 of the first section 3 and that the upper, second portion 42 of the second section 4 has a thickness $T_{y2}$ which is smaller than the thickness $T_{y1}$ of the first portion 41 of the second section 4.

Figure 6:
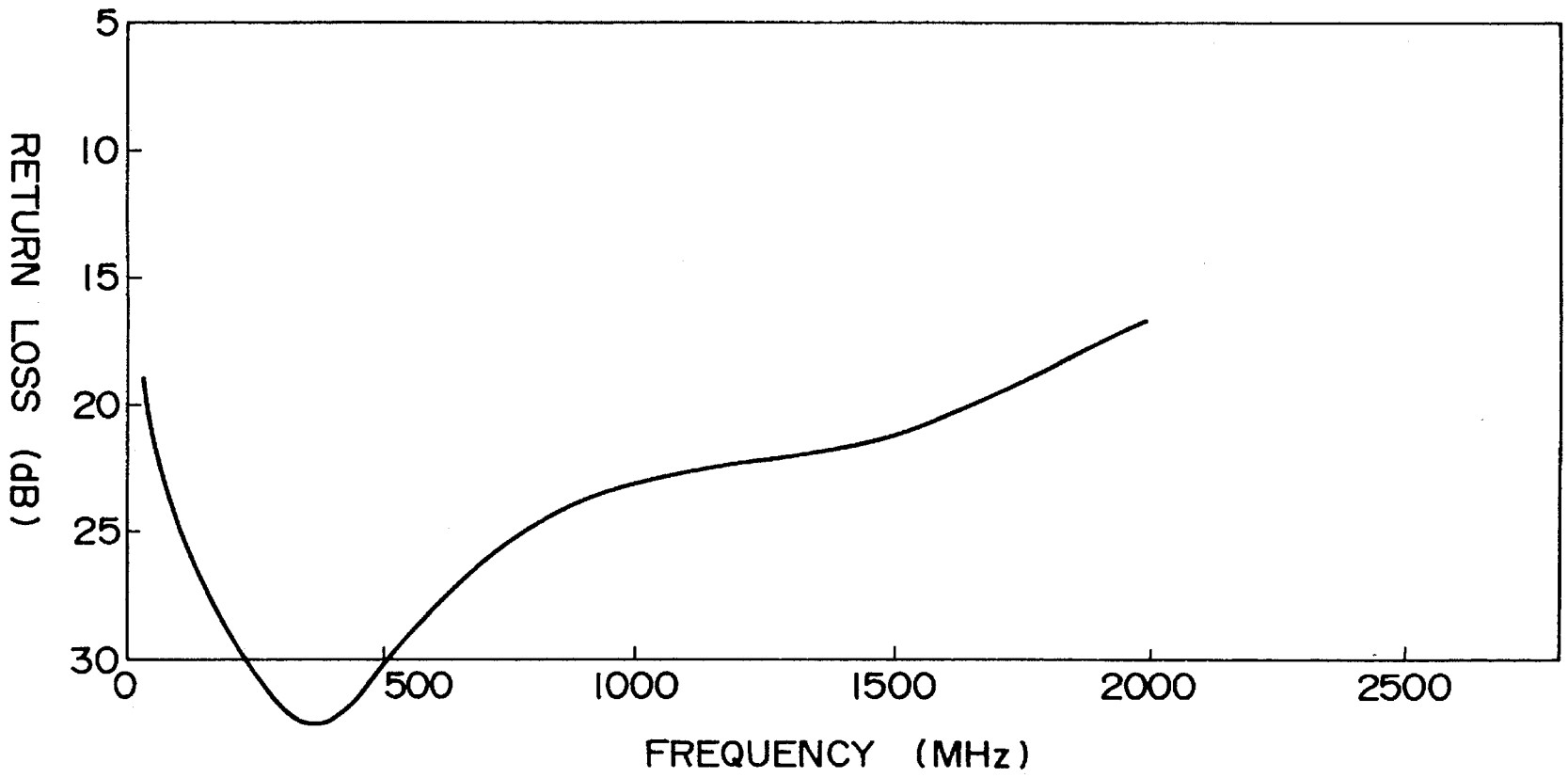
FIG. 6 is a graph showing radio wave absorbing characteristics of the radio wave absorber of FIG. 4.

When the wave absorber shown in FIG. 4 is constructed as summarized below, the absorption characteristics thereof is as shown in FIG. 6. It will be appreciated that the wave absorber shows a return loss of 20 dB or more for a radio wave frequency in the range of 30–1,650 MHz.

Material of magnetic member: NiZn sintered ferrite

Relative permeability of ferrite: 2,500

Distance between magnetic members ($P_x$, $P_y$): 20 mm

Lower layer:
- First portion (31, 41):
  - Length $L_{x1}$, $L_{y1}$: 20 mm
  - Thickness $T_{x1}$, $T_{y1}$: 15 mm
  - Height $H_1$: 7.7 mm
- Apparent relative permeability: about 1,880
- Apparent relative dielectric constant: about 12

Upper layer:
- Second portion (32, 42):
  - Length $L_{x2}$, $L_{y2}$: 16.2 mm
- Thickness $T_{x2}$, $T_{y2}$: 4 mm
- Height $H_2$: 28 mm Aperture $S_x$, $S_y$: 3.8 mm Apparent relative permeability: about 2

Apparent relative dielectric constant: 1.77

Figure 7:
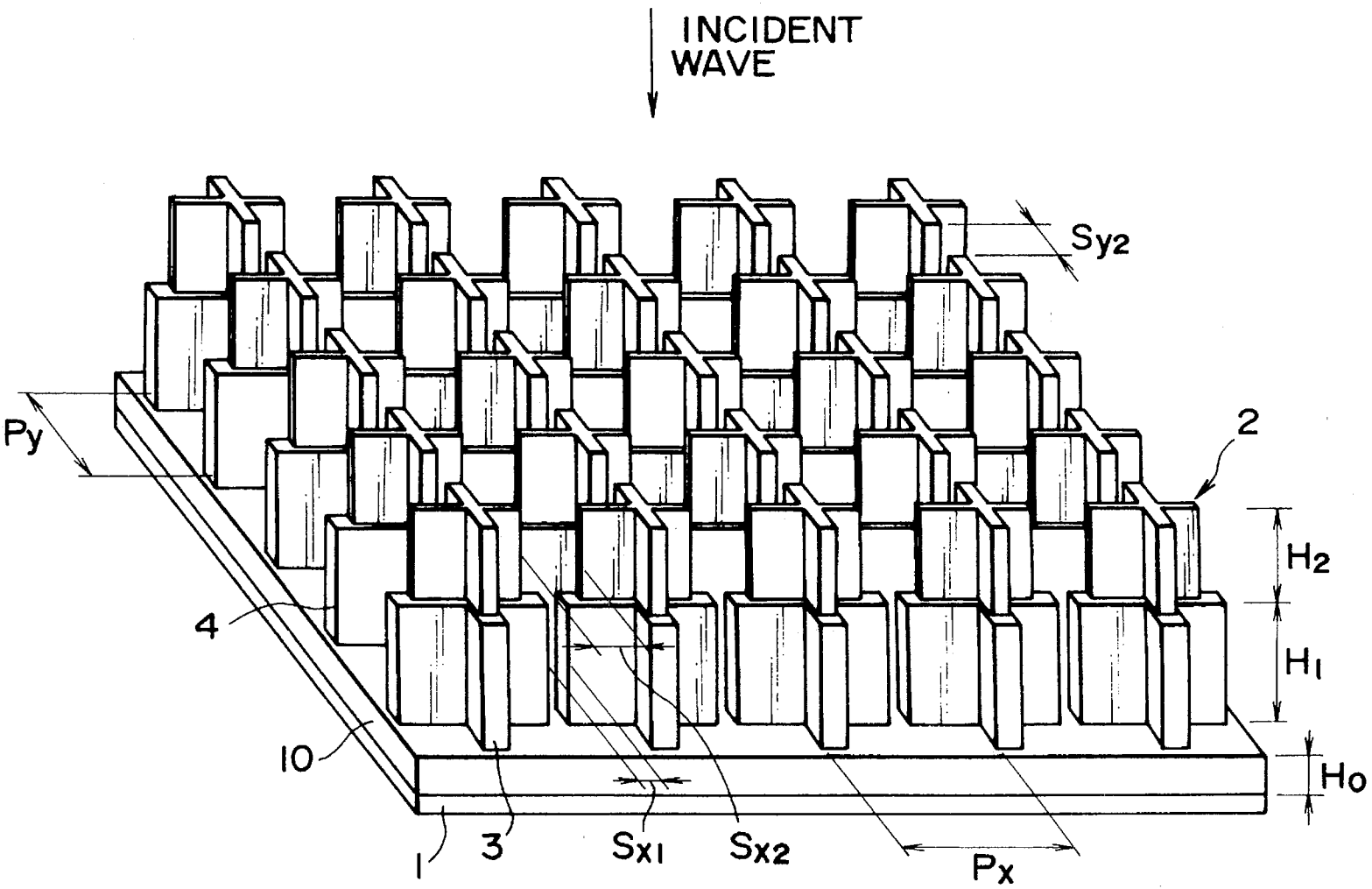
FIG. 7 is a perspective view showing a further embodiment of a radio wave absorber according to the present invention.
Figure 8A:
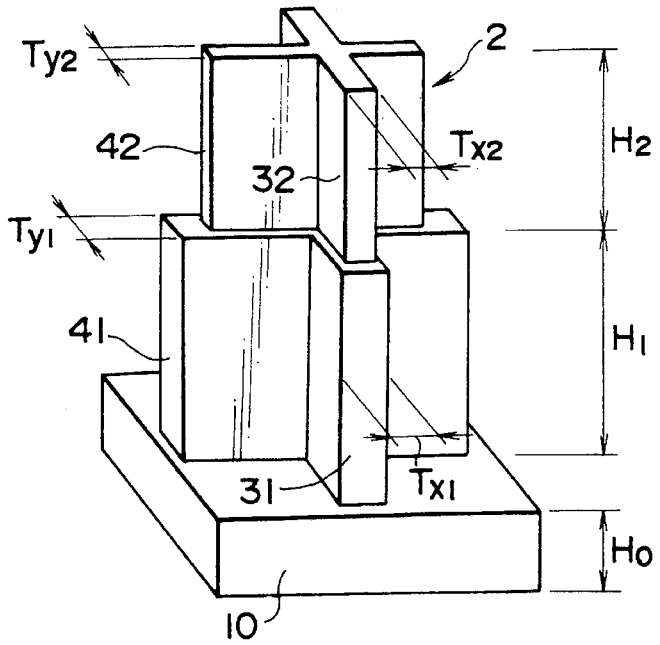
FIG. 8(*a*) is a perspective view showing a magnetic member of the embodiment of FIG. 7.
Figure 8B:
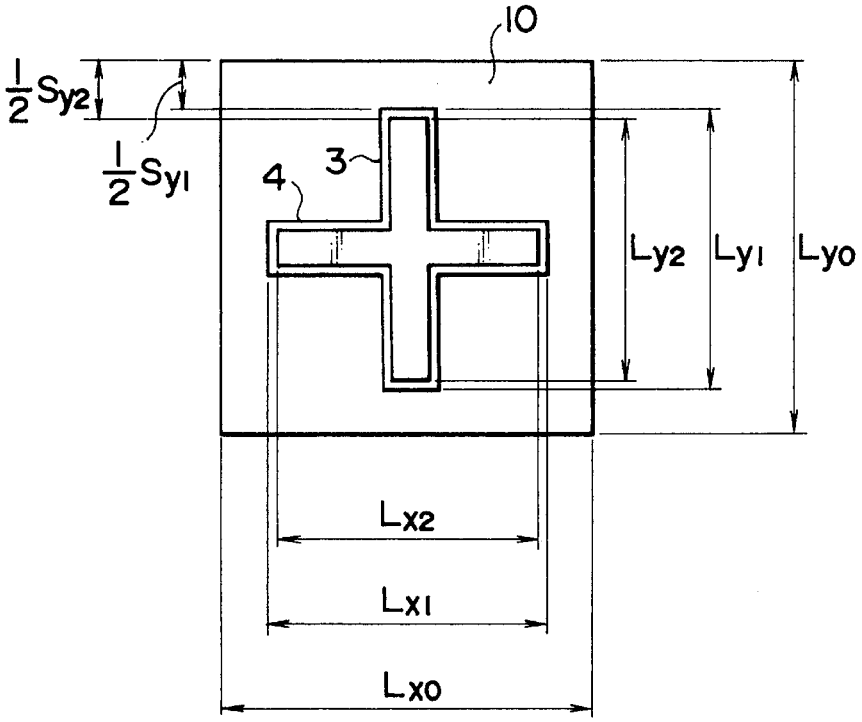

FIGS. 7 and 8(*a*)–8(*b*) illustrate an embodiment similar to that of FIG. 4 except that a flat tile-like magnetic layer 10 is interposed between the reflecting plate and each of the plurality of magnetic members 2 and that an aperture is formed not only between adjacent two upper portions but also between adjacent two lower portions.

Figure 9:
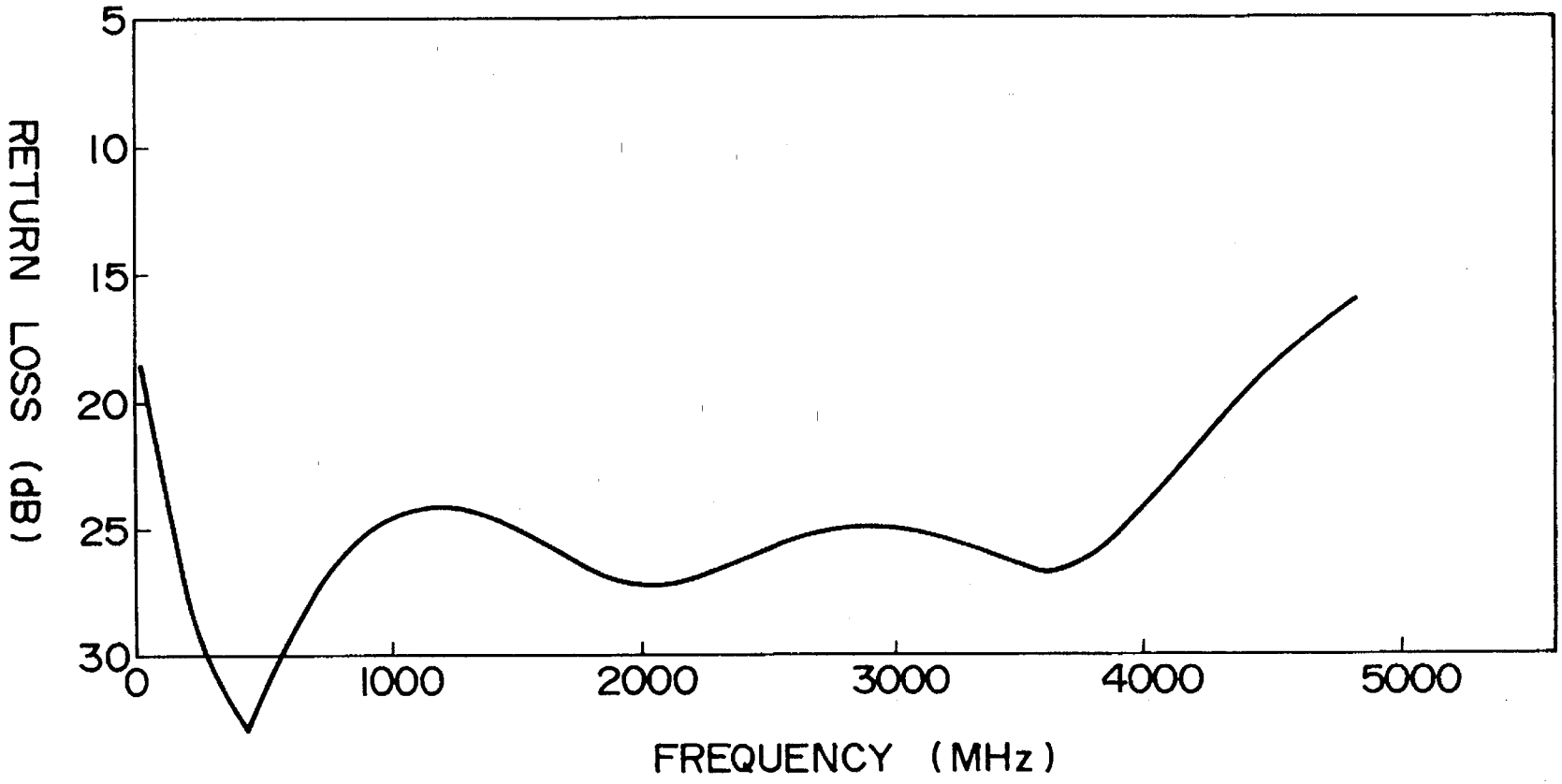
FIG. 9 is a graph showing radio wave absorbing characteristics of the radio wave absorber of FIG. 7.

When each of the magnetic members 2 shown in FIG. 7 is constructed as summarized below, the absorption characteristics of the wave absorber is as shown in FIG. 9. It will be appreciated that the wave absorber shows a return loss of 20 dB or more for a radio wave frequency in the range of 30–4,400 MHz.

Material of magnetic member: NiZn sintered ferrite

Relative permeability of ferrite: 2,500

Lower layer:
- Flat plate 10:
  - Length $L_{x0}$ and $L_{y0}$: 20 mm
  - Height (Thickness) $H_0$: 5.7 mm
- Apparent relative permeability: 2,500
- Apparent relative dielectric constant: about 15

Distance between magnetic members ($P_x$, $P_y$): 20 mm

Intermediate layer:
- First portion (31, 41):
  - Length $L_{x1}$, $L_{y1}$: 17.5 mm
  - Thickness $T_{x1}$, $T_{y1}$: 6 mm
  - Height $H_1$: 14 mm
- Aperture $S_{x1}$, $S_{y1}$: 2.5 mm
- Apparent relative permeability: about 3.3
- Apparent relative dielectric constant: about 2.6

Upper layer:
- Second portion (32, 42):
  - Length $L_{x2}$, $L_{y2}$: 12.5 mm
  - Thickness $T_{x2}$, $T_{y2}$: 4 mm
  - Height $H_2$: 18 mm
- Aperture $S_{x2}$, $S_{y2}$: 7.5 mm
- Apparent relative permeability: about 1.4
- Apparent relative dielectric constant: 1.4

Figure 10:
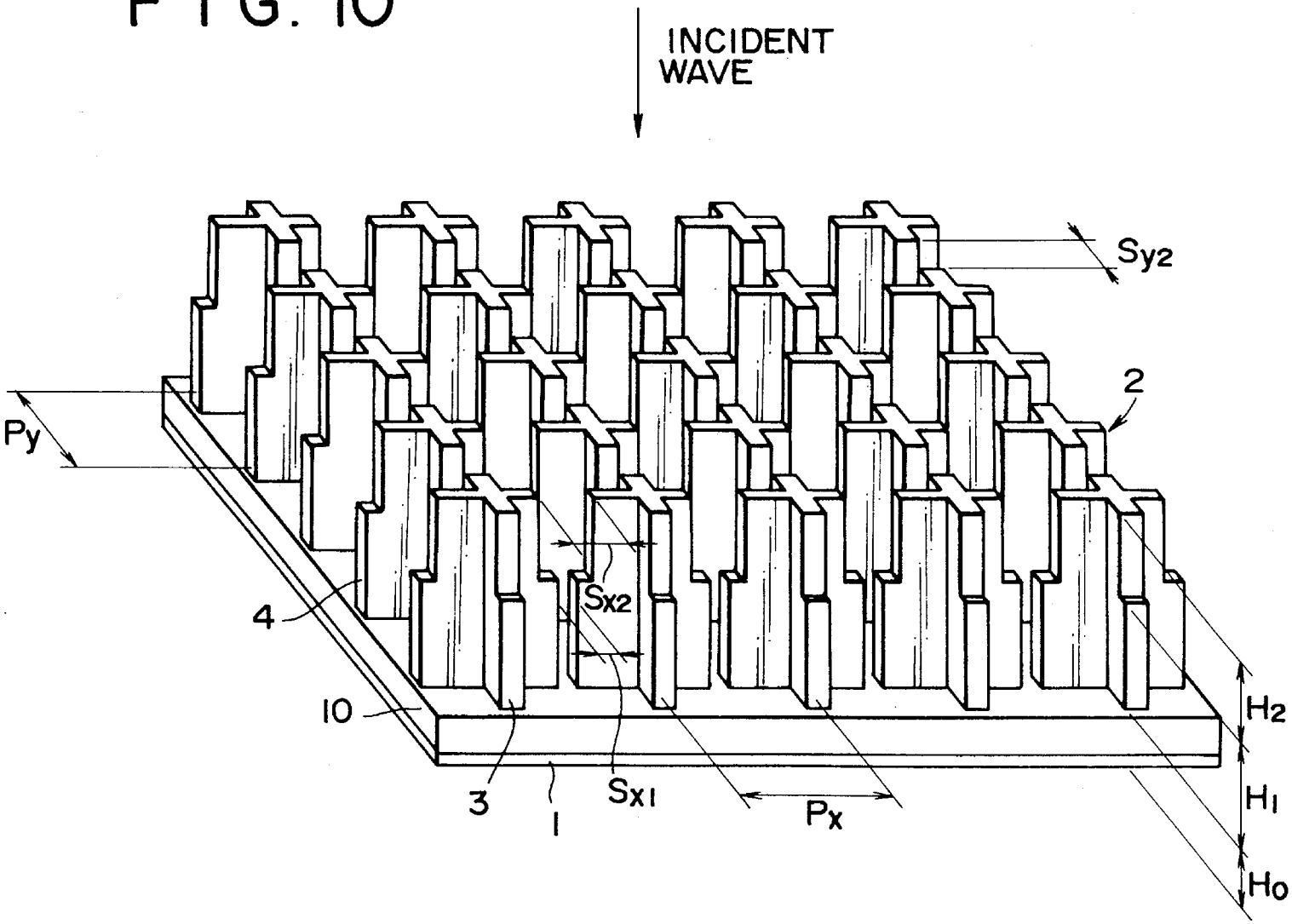
FIG. 10 is a perspective view showing a further embodiment of a radio wave absorber according to the present invention.
Figure 11A:
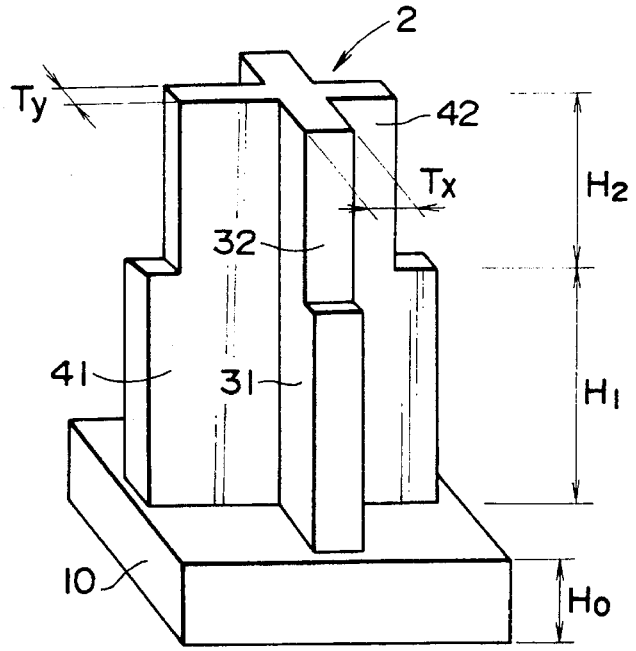
FIG. 11(*a*) is a perspective view showing a magnetic member of the embodiment of FIG. 10.
Figure 11B:
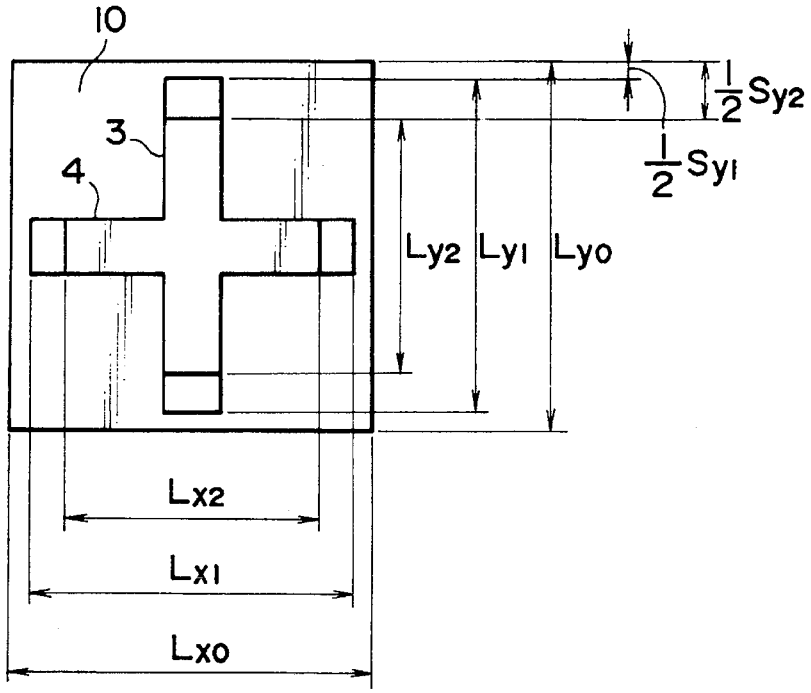

FIGS. 10 and 11(*a*)–11(*b*) illustrate an embodiment similar to that of FIG. 1 except that a flat tile-like magnetic layer 10 is interposed between the reflecting plate 1 and each of the plurality of magnetic members 2 and that an aperture is formed not only between adjacent two upper portions but also between adjacent two lower portions.

Figure 12:
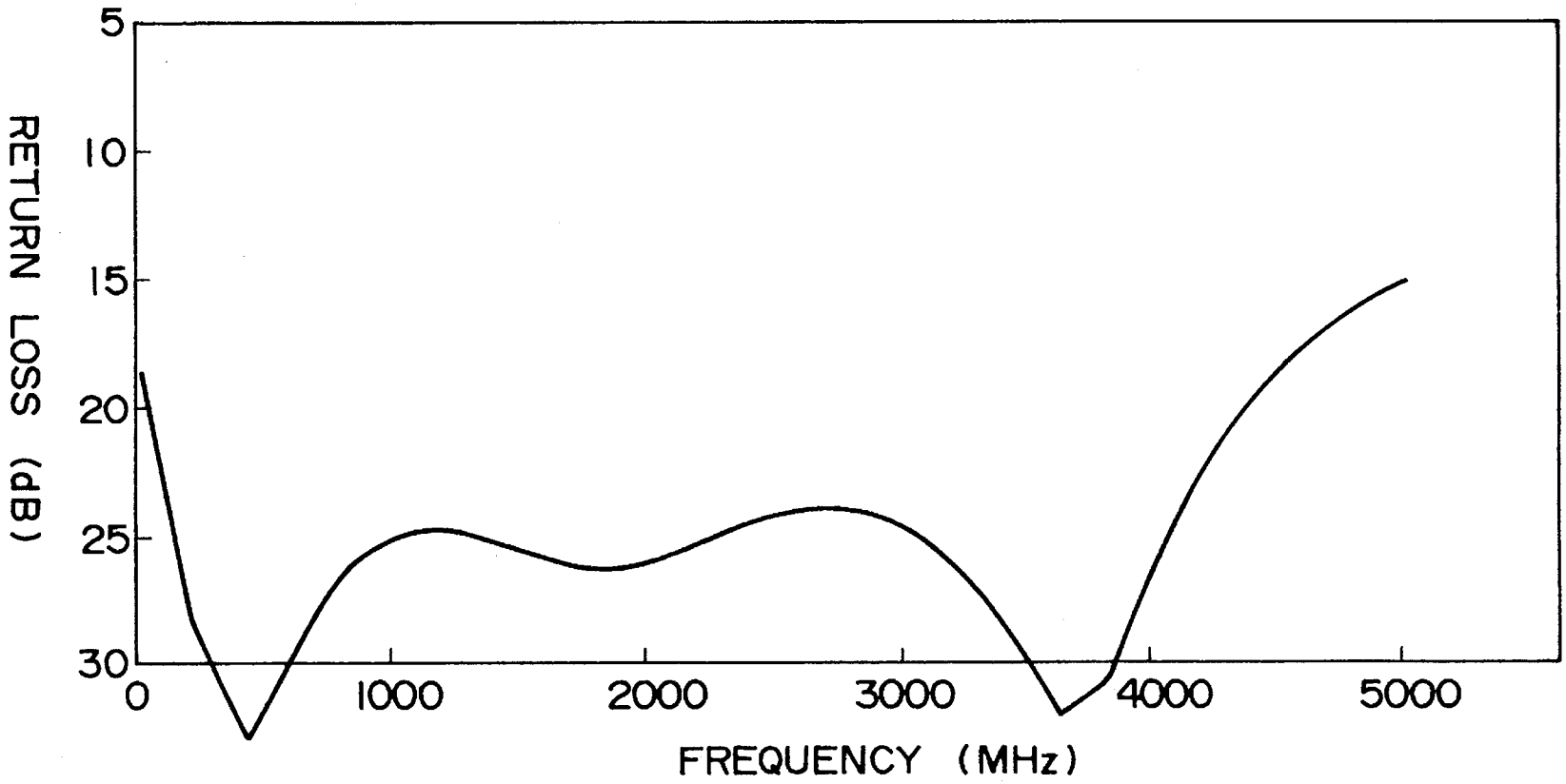
FIG. 12 is a graph showing radio wave absorbing characteristics of the radio wave absorber of FIG. 10.

When each of the magnetic members 2 shown in FIG. 10 is constructed as summarized below, the absorption characteristics of the wave absorber is as shown in FIG. 12. It will be appreciated that the wave absorber shows a return loss of 20 dB or more for a radio wave frequency in the range of 30–4,400 MHz.

Material of magnetic member: NiZn sintered ferrite

Relative permeability of ferrite: 2,500

Lower layer:
- Flat plate 10:
  - Length $L_{x0}$ and $L_{y0}$:20 mm
  - Height (Thickness) $H_0$: 5.7 mm
- Apparent relative permeability: 2,500
- Apparent relative dielectric constant: about 15

Distance between magnetic members ($P_x$, $P_y$): 20 mm

Intermediate layer:
- First portion (31, 41):
  - Length $L_{x1}$, $L_{y1}$: 17.5 mm
  - Thickness $T_x$, $T_y$: 6 mm
  - Height $H_1$: 14 mm
- Aperture $S_{x1}$, $S_{y1}$: 2.5 mm
- Apparent relative permeability: about 3.3
- Apparent relative dielectric constant: about 2.6

Lower layer:
- Second portion (32, 42):
  - Length $L_{x2}$, $L_{y2}$: 11.5 mm
  - Thickness $T_x$, $T_y$: 6 mm
  - Height $H_2$: 18 mm
- Aperture $S_{x2}$, $S_{y2}$: 8.5 mm
- Apparent relative permeability: about 1.5
- Apparent relative dielectric constant: 1.5

Figure 13:
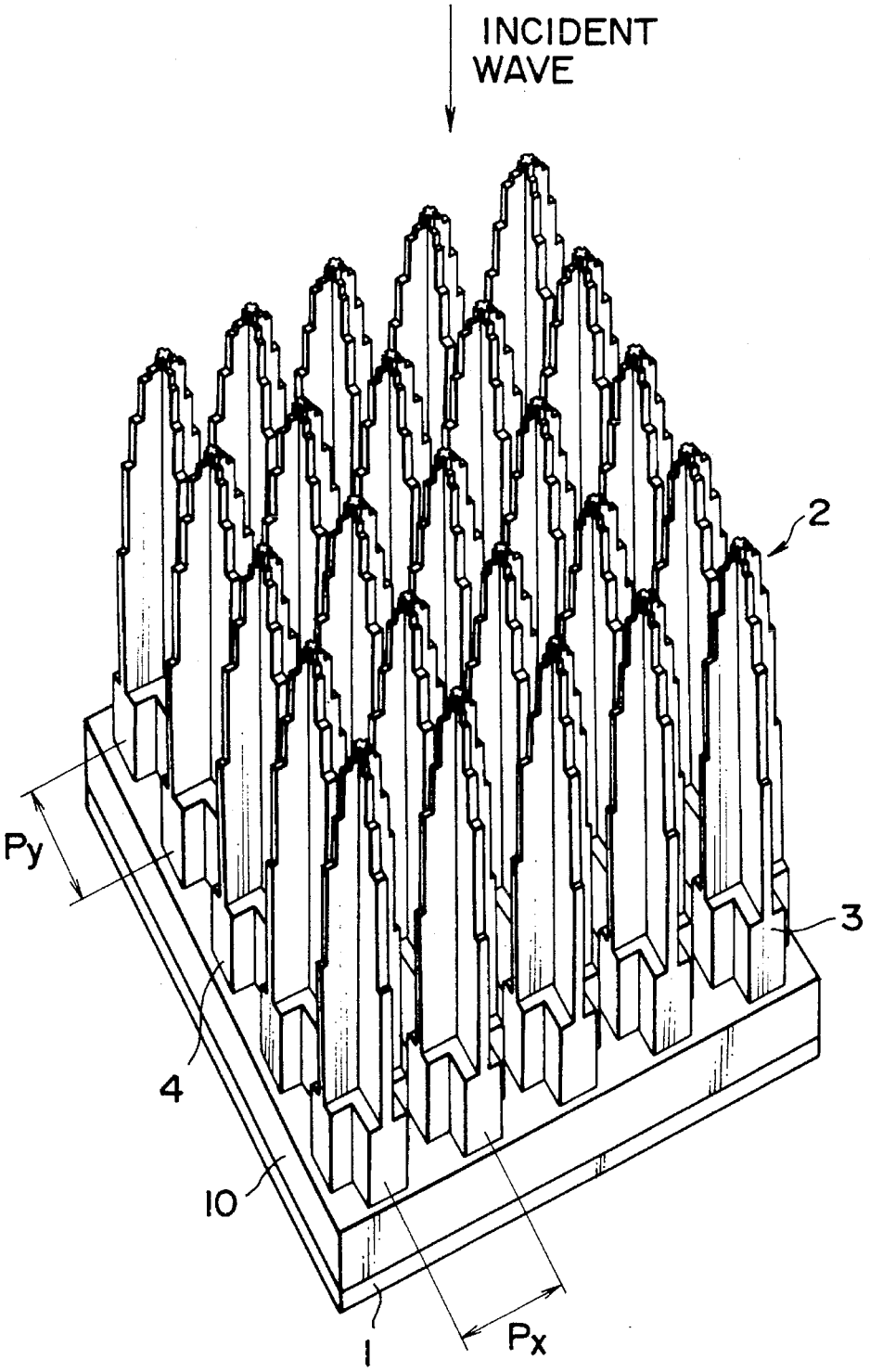
FIG. 13 is a perspective view showing a further embodiment of a radio wave absorber according to the present invention.
Figure 14A:
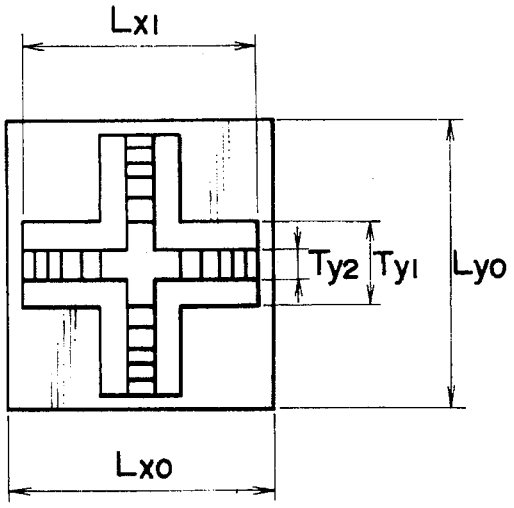
FIG. 14(*a*) is a plan view showing a magnetic member of the embodiment of FIG. 13.
Figure 14B:
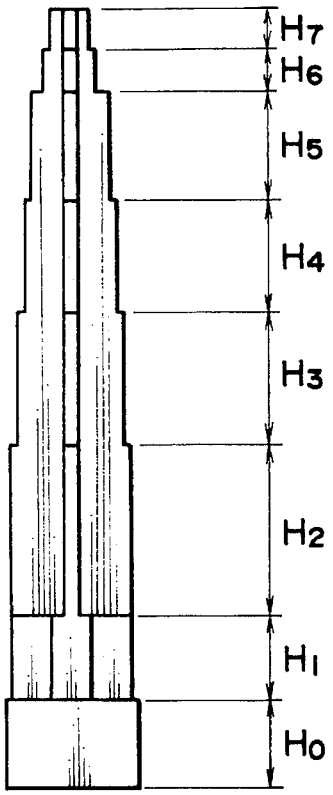

FIGS. 13 and 14(*a*)–14(*b*) show an embodiment similar to that of FIG. 10 except that the magnetic member 2 has an eight-layer structure having seven superimposed portions on a flat tile-like magnetic layer 10.

Figure 15:
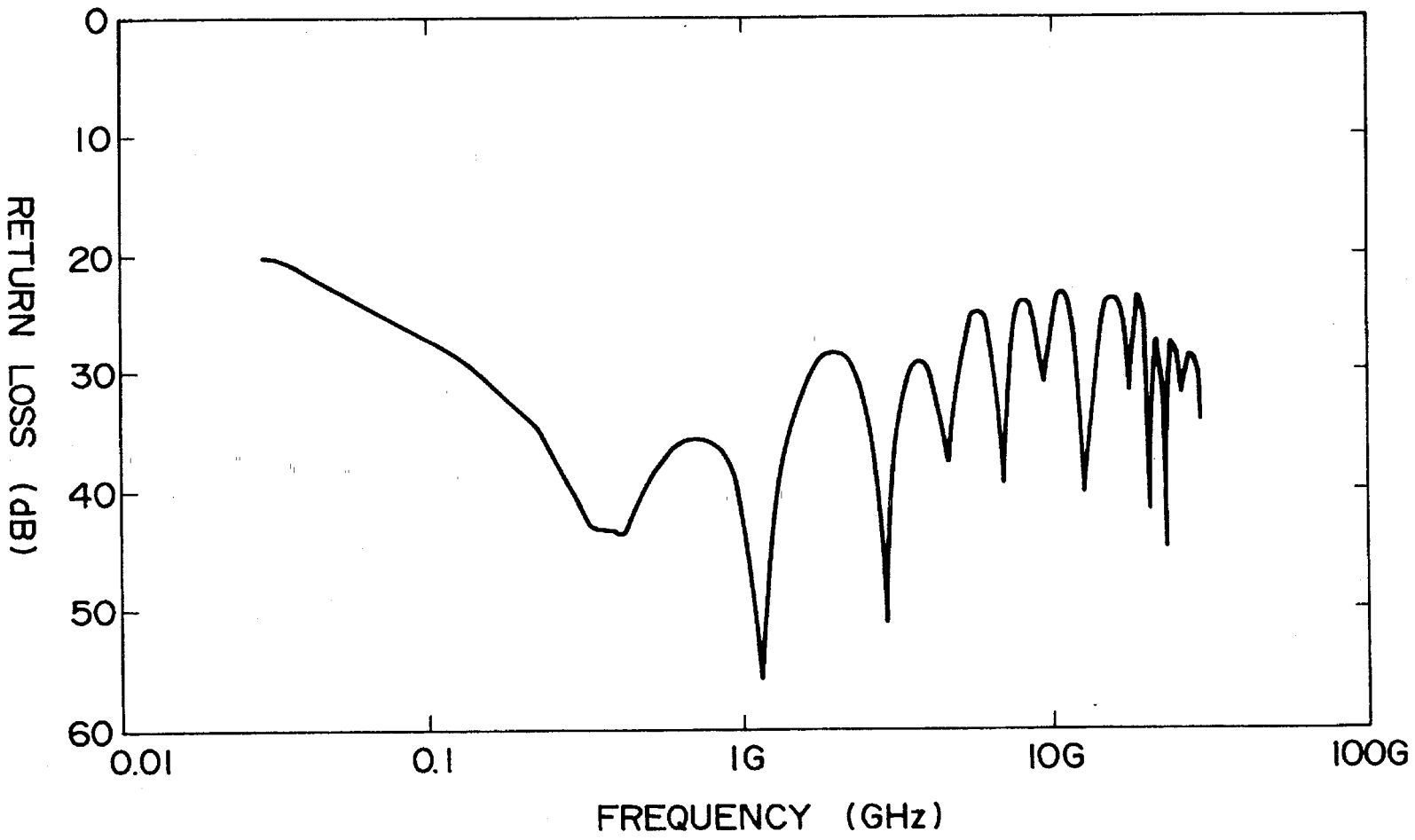
FIG. 15 is a graph showing radio wave absorbing characteristics of the radio wave absorber of FIG. 13.

When each of the magnetic members 2 shown in FIG. 13 is constructed as summarized below, the absorption characteristics of the wave absorber is as shown in FIG. 15. It will be appreciated that the wave absorber shows a return loss of 20 dB or more for a radio wave frequency in the range of 30 MHz to 30 GHz.

Material of magnetic member: NiZn sintered ferrite

Relative permeability of ferrite: 2,500

Lowermost layer:
- Flat plate 10:
  - Length $L_{x0}$ and $L_{y0}$: 10 mm
  - Height (Thickness) $H_0$: 6 mm
- Apparent relative permeability: 2,500
- Apparent relative dielectric constant: about 15
- Distance between magnetic members ($P_x$, $P_y$): 10 mm The thickness T, length L, height H, aperture S, relative permeability $\mu_r$ and relative dielectric constant $\epsilon_r$ of respective layers are summarized in Table below. The thickness and length of each portion and aperture of each layer in the direction parallel with the X-axis are the same as those in the Y-axis.

TABLE

| Layer | H (mm) | T (mm) | L (mm) | S (mm) | $\mu_r$ | $\epsilon_r$ |
|---|---|---|---|---|---|---|
| | Dimension of Superimposed Layers | | | | | |
| 1st | $H_0 = 6$ | 10 | 10 | 0 | 2,500 | 15.0 |
| 2nd | $H_1 = 7$ | 6 | 8.65 | 1.35 | 5.24 | 3.85 |
| 3rd | $H_2 = 13$ | 2 | 8.65 | 1.35 | 2.45 | 1.99 |
| 4th | $H_3 = 9$ | 2 | 8.00 | 2.00 | 1.95 | 1.73 |
| 5th | $H_4 = 8$ | 2 | 7.00 | 3.00 | 1.59 | 1.49 |
| 6th | $H_5 = 8$ | 2 | 6.00 | 4.00 | 1.40 | 1.35 |
| 7th | $H_6 = 4$ | 2 | 4.50 | 5.50 | 1.23 | 1.20 |
| 8th | $H_7 = 3$ | 2 | 3.00 | 7.00 | 1.11 | 1.10 |

When each of the magnetic members 2 has a number of superimposed portions like the above embodiment, it is preferred that lower portions (generally first to third portions) be formed of sintered ferrite whereas the remainder upper portions be formed of a rubber ferrite which is lighter in weight than sintered ferrite, for reasons of reduction of the total weight.

Figure 16:
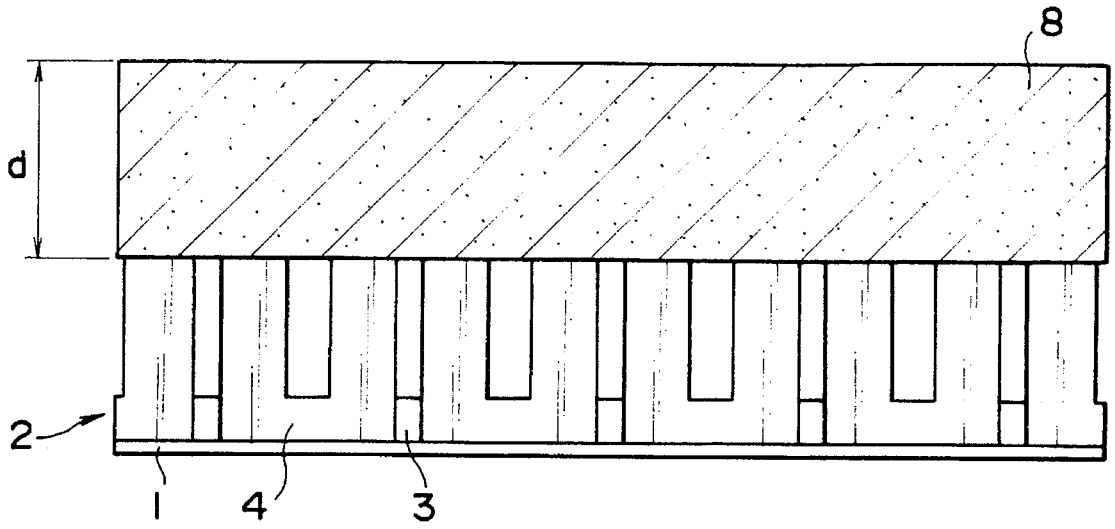
FIG. 16 is an elevational view showing a further embodiment of a radio wave absorber according to the present invention.
Figure 17:
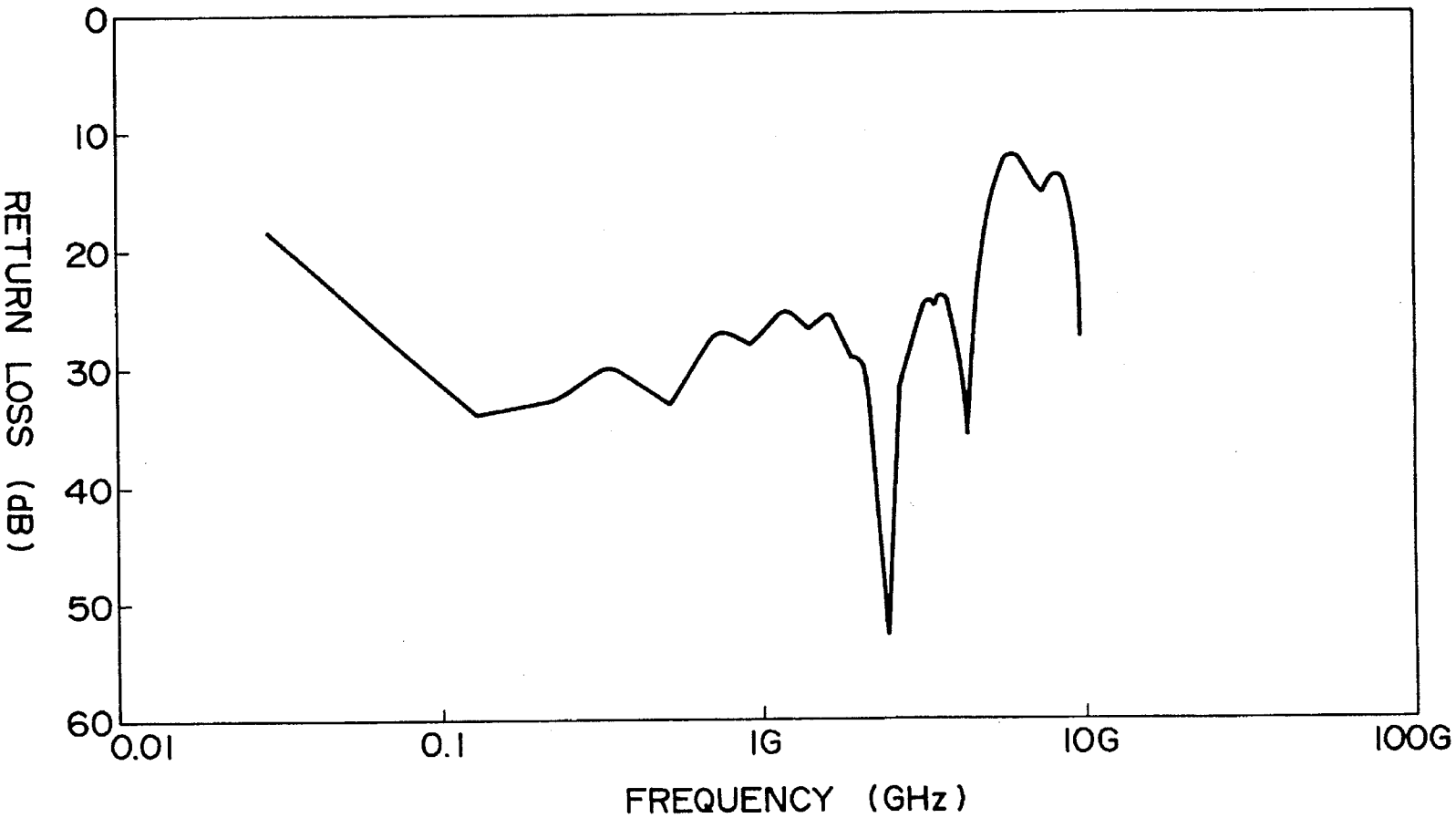
FIG. 17 is a graph showing radio wave absorbing characteristics of the radio wave absorber of FIG. 16.

FIG. 16 illustrates an embodiment similar to that of FIG. 1 having the absorption characteristics shown in FIG. 3 except that a layer 8 of a loss dielectric material is provided on the front of the magnetic members 2. When the layer 8 is formed of a foamed polyurethane which contains 0.5 g of homogeneously dispersed carbon powder per 1 liter volume of the polyurethane foam and which has a relative dielectric constant of about 1.2 and when the layer 8 has a thickness d of 300 mm and is provided to cover the entire top surface of the magnetic members 2, the resulting wave absorber shows absorbing characteristics as shown in FIG. 17. It will be noted that the provision of the loss dielectric layer 8 shows a return loss of 20 dB or more for a radio wave frequency in the range of 30 MHz to 5 GHz.

The size of the magnetic member 2 in the foregoing embodiments may vary with the intended use of the broad-band radio wave absorber. Generally, the size of the magnetic member 2 is determined in consideration of the maximum and minimum frequencies of the incident radio wave. For example, when the incident radio wave has maximum and minimum frequencies of 20 GHz and 30 MHz, respectively, the preferred dimensions of the magnetic member 2 are as follows:

| | | |
|---|---|---|
| Distance $P_x$, $P_y$: | 3–40 mm | |
| Length $L_{x1}$, $L_{y1}$: | 4–40 mm | |
| Thickness $T_x$, $T_y$: | 0.5–40 mm | |
| Height $H_1$: | 4–40 mm | |
| Length $L_{x2}$, $L_{y2}$: | 3–36 mm | |
| Height $H_2$: | 5–50 mm | |
| Aperture $S_{x1}$, $S_{y1}$: | 0.1–20 mm | |
| Thickness $H_0$: | 4–10 mm | (tile-like plate 10) |
| Thickness d: | ≧ 50 mm | (loss dielectric layer 8) |

Figure 18:
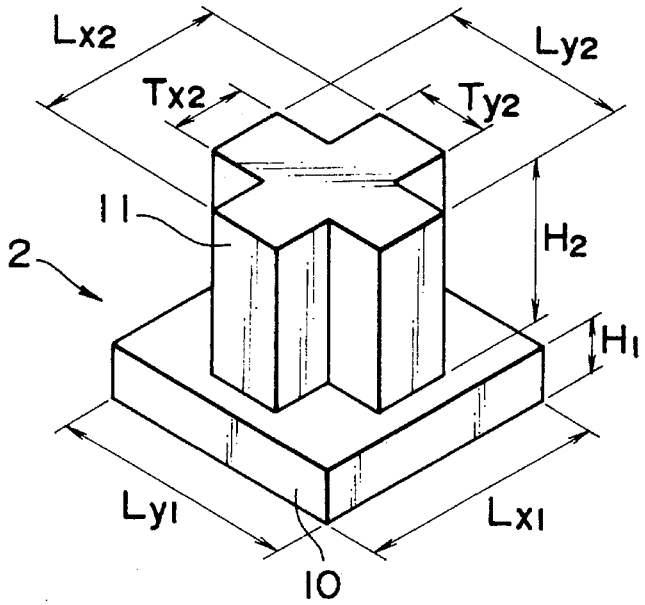
FIG. 18 is a perspective view, similar to FIG. 5(*a*), showing a further embodiment of a magnetic member of a radio wave absorber according to the present invention.

In the embodiment shown in FIGS. 4 and 5(*a*)–5(*c*), when the thicknesses $T_{x1}$ and $T_{y1}$ are increased and are equal to the lengths $L_{x1}$ and $L_{y1}$, respectively, and when the lengths $L_{x1}$ and $L_{y1}$ are equal to the distances $P_x$ and $P_y$, respectively, then the structure becomes as illustrated in FIG. 18. The lower layer is a tile-like plate 10 while the upper layer includes a rectangular parallelepiped block 11.

Figure 19:
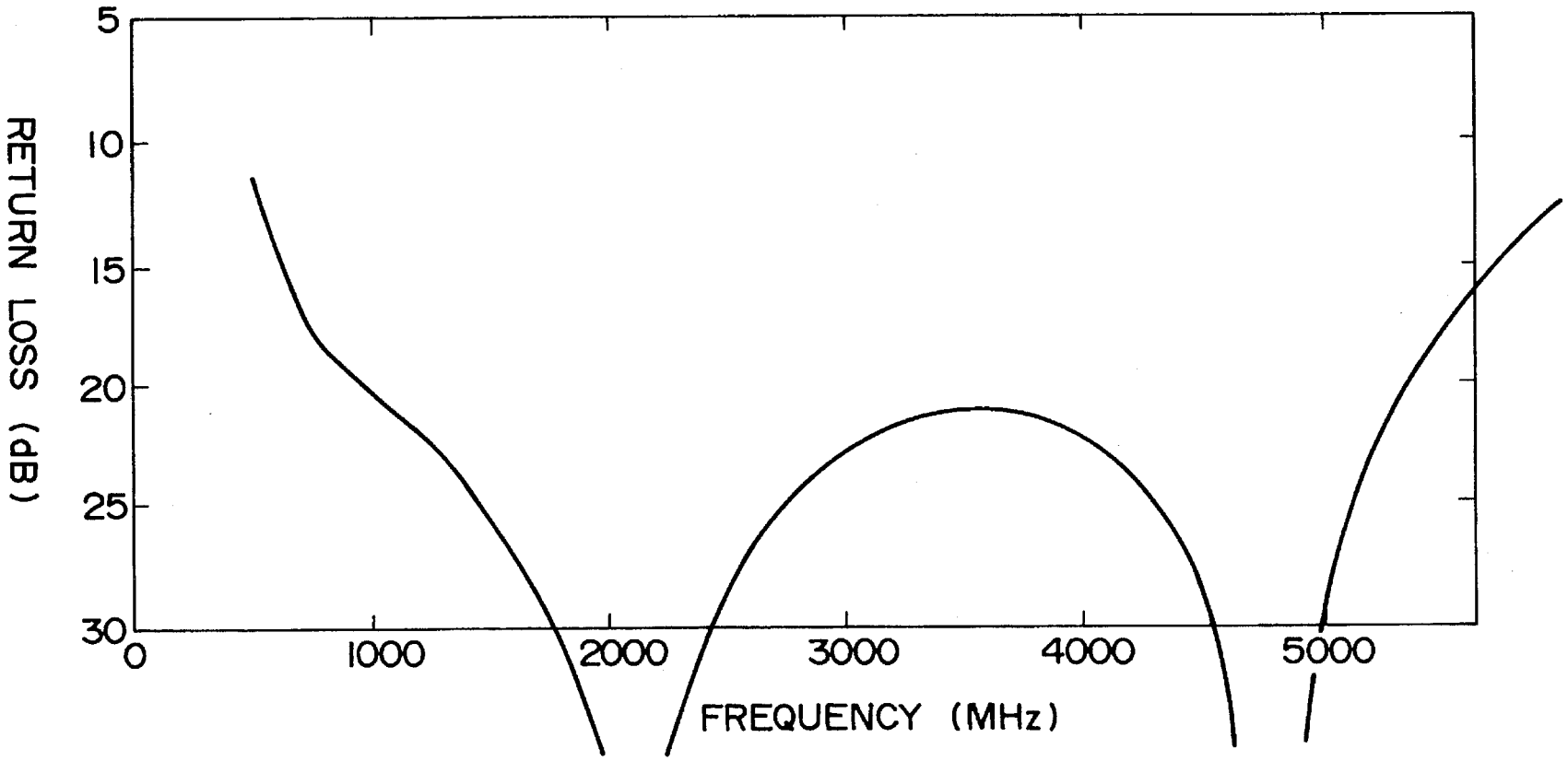
FIG. 19 is a graph showing radio wave absorbing characteristics of the radio wave absorber of FIG. 18.

When the magnetic member 2 shown in FIG. 18 is constructed as summarized below, the absorption characteristics of the wave absorber is as shown in FIG. 19. It will be appreciated that the wave absorber shows a return loss of 20 dB or more for a radio wave frequency in the range of 1,000–5,300 MHz.

Material of magnetic member: ferrite rubber containing 10 parts by weight of 5–50 μm diameter NiZn sintered ferrite powder dispersed in 1 part by weight of a chloroprene rubber matrix Relative permeability of ferrite rubber: about 10

Relative dielectric constant of ferrite rubber: about 11

Distance between magnetic members ($P_x$, $P_y$): 20 mm

Lower layer:

Tile-like plate 10:

Length $L_{x1}$, $L_{y1}$ (Thickness $T_{x1}$, $T_{y1}$): 20 mm

Height $H_1$: 5 mm

Apparent relative permeability: about 10

Apparent relative dielectric constant: about 11

Upper layer:

Block 11:

Length $L_{x2}$, $L_{y2}$: 16.5 mm

Thickness $T_{x2}$, $T_{y2}$:6 mm

Height $H_2$:15 mm

Aperture $S_x$, $S_y$: 3.5 mm

Apparent relative permeability: about 2.25

Apparent relative dielectric constant: 2.1

Figure 20:
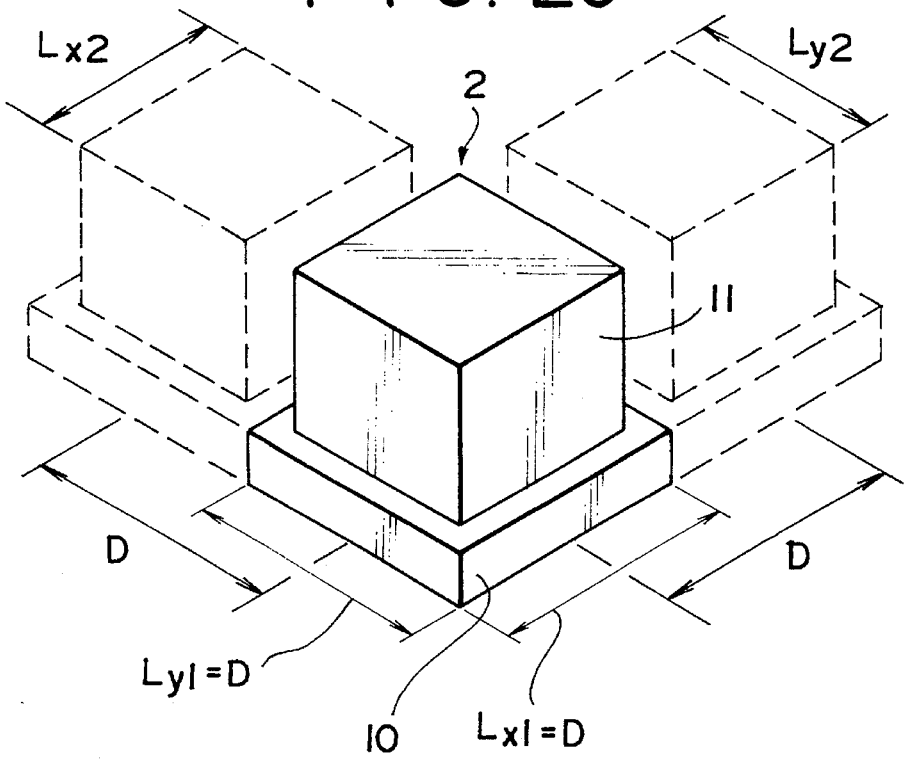
FIG. 20 is a perspective view, similar to FIG. 5(*a*), showing a further embodiment of a magnetic member of a radio wave absorber according to the present invention.

In the embodiment shown in FIGS. 4 and 5(*a*)–5(*c*), when the thicknesses $T_{x1}$, $T_{y1}$, $T_{x2}$ and $T_{y2}$ are increased and become equal to the lengths $L_{x1}$, $L_{y1}$, $L_{x2}$ and $L_{y2}$, respectively, and when the lengths $L_{x1}$ and $L_{y1}$ are equal to the distances $P_x$ and $P_y$, respectively, then the structure becomes as illustrated in FIG. 20 which corresponds to FIG. 5(*a*). The lower layer is a tile-like plate 10 and the upper layer includes a rectangular parallelepiped block 11. In this case, it is preferred that the lengths $L_{x1}$, $L_{y1}$, $L_{x2}$ and $L_{y2}$ satisfy the following conditions:

$$0.65L_{x1} \leqq L_{x2} \leqq 0.85L_{x1}$$

$$0.65L_{y1} \leqq L_{y2} \leqq 0.85L_{y1}.$$

Figure 21:
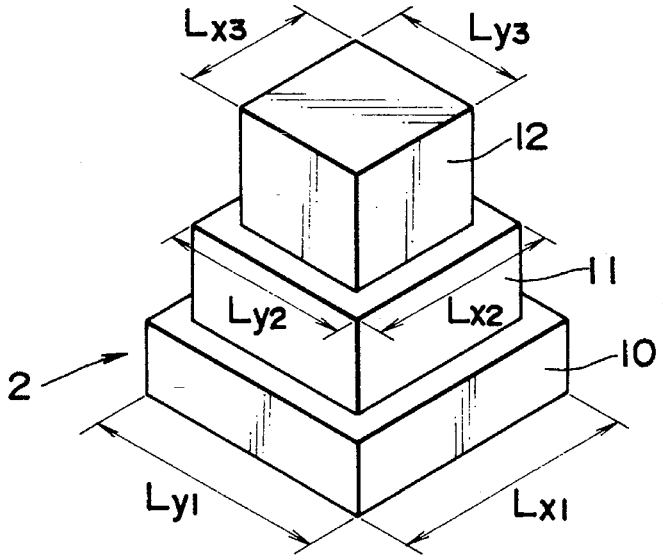
FIG. 21 is a perspective view, similar to FIG. 5(*a*), showing a further embodiment of a magnetic member of a radio wave absorber according to the present invention.

Although the wave absorber of FIG. 20 has a two layered structure, the number of the stacked layers may be increased to three or more. FIG. 21 illustrate a three layered stacked structure which is the same as that of FIG. 20 except that a top block 12 having lengths $L_{x3}$ and $L_{y3}$ along the X- and Y-axes, respectively, is superimposed on the block 11. In this case, it is preferred that the lengths $L_{x1}$, $L_{y1}$, $L_{x2}$, $L_{y2}$, $L_{x3}$ and $L_{y3}$ satisfy the following conditions:

$$0.65L_{x1} \leqq L_{x2} \leqq 0.85L_{x1}$$

$$0.65L_{y1} \leqq L_{y2} \leqq 0.85L_{y1}$$

$$0.35L_{x1} \leqq L_{x3} \leqq 0.65L_{x1}$$

$$0.35L_{y1} \leqq L_{y3} \leqq 0.65L_{y1}.$$

The preferred embodiments of FIGS. 20 and 21 may be defined as a broad-band radio wave absorber which comprises a radio wave reflecting surface 1, and a plurality of magnetic members 2 provided on the reflecting surface 1 and arranged in columns and rows in the directions of the X- and Y-axes, respectively, each of the magnetic members 2 having a plurality of portions 10, 11, 12 superimposed in turn in a stepwise manner and each having a square cross-section on the X-Y plane with opposing sides of the square being oriented in the direction parallel with the X- or Y-axis, wherein the cross-sectional area on the X-Y plane in each of the portions decreases from the lowermost portion toward the uppermost portion of each of the magnetic members, wherein the axes of the rows are spaced apart at an equidistance from each other by a distance D ($=P_x=P_y$) and the axes of the columns are spaced apart at an equidistance from each other by the distance D, and wherein the lowermost portion 10 of each of the magnetic members 2 has a width ($L_{x1}$, $L_{y1}$) which is equal to the distance D (the reference numerals and symbols not shown in FIGS. 20 and 21 are similar to those shown in FIGS. 4 and 5(*a*)–5(*c*)).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A broad-band radio wave absorber comprising a radio wave reflecting surface, and a plurality of magnetic members provided on said reflecting surface and arranged in columns and rows in the directions of the X-axis and Y-axis, respectively, each of said magnetic members including a first section extending in parallel with the Y-axis and a second section in contact with said first section throughout the height thereof and extending in parallel with the X-axis, such that said first sections of respective magnetic members in each row are aligned and said second sections of respective magnetic members in each column are aligned and that said first sections in each column are spaced apart from each other at a distance $P_x$ and said second sections in each row are spaced apart from each other at a distance $P_y$, each of said first and second sections being composed of a plurality of portions superimposed in turn in a stepwise manner, one portion of said plurality of portions of each of said first sections having a length along the Y-axis of $L_y$ and a thickness along the X-axis of $T_x$, and one portion of said plurality of portions of each of said second sections having a length along the X-axis of $L_x$ and a thickness along the Y-axis of $T_y$, wherein $L_y$, $P_y$, $T_y$, $L_x$, $P_x$ and $T_x$ meet with the following conditions:

$T_y<L_y<P_y$ and $T_x<L_x<P_x$.

2. An absorber as claimed in claim 1, wherein at least either one of the thickness of each of said portions of said first and second sections and the length of each of said portions of said first and second sections is smaller from the bottom of each of said magnetic member towards the top thereof.

3. An absorber as claimed in claim 2, wherein the thickness of each of said portions of said first section is the same and the thickness of each of said portions of said second sections is the same while the length of each of said portions of said first and second sections is smaller from the bottom of each of said magnetic member towards the top thereof.

4. An absorber as claimed in claim 2, wherein the thickness of each of said portions of said first and second sections is smaller from the bottom of each of said magnetic member towards the top thereof.

5. An absorber as claimed in claim 2, wherein both the thickness and the length of each of said portions of said first and second sections are smaller from the bottom of each of said magnetic member towards the top thereof.

6. An absorber as claimed in claim 2, wherein said plurality of superimposed portions of each of said first and second sections includes a first, lower portion wherein said first portion of said first section has a length $L_{y1}$ equal to said distance $P_y$ and said first portion of said second section has a length $L_{x1}$ equal to said distance $P_x$.

7. An absorber as claimed in claim 6, wherein a thickness $T_{x2}$ of a second portion of said first section is smaller than a thickness $T_{x1}$ of said first portion of said first section and a thickness $T_{y2}$ of a second portion of said second section is smaller than a thickness $T_{y1}$ of said first portion of said second section.

8. An absorber as claimed in claim 6, wherein a thickness of a second portion of said first section is equal to a thickness of said first portion of said first section and a thickness of a second portion of said second section is equal to a thickness of said first portion of said second section.

9. An absorber as claimed in claim 6 wherein said first portion of said first section has a thickness $T_{x1}$ equal to said distance $P_x$ and said first portion of said second section has a thickness $T_{y1}$ equal to said distance $P_y$.

10. An absorber as claimed in claim 1, wherein said first and second sections of each of said magnetic members are disposed in a crosswise manner.

11. An absorber as claimed in claim 1, wherein each of said magnetic members is formed of a ferrite-containing material.

12. An absorber as claimed in claim 1, further comprising a flat magnetic layer interposed between said reflecting plate and said plurality of magnetic members.

13. An absorber as claimed in claim 1, further comprising a layer of a loss dielectric material provided to cover top surfaces of said plurality of magnetic members.

14. A broad-band radio wave absorber comprising a radio wave reflecting surface, and a plurality of magnetic members provided on said reflecting surface and arranged in columns and rows in the directions of the X- and Y-axes, respectively, each of said magnetic members having a plurality of portions superimposed in turn in a stepwise manner and each having a square cross-section on the X-Y plane with opposing sides of said square being oriented in the direction parallel with the X- or Y-axis, wherein the cross-sectional area on the X-Y plane in each of said portions decreases from the lowermost portion toward the uppermost portion of each of said magnetic members, wherein the axes of said rows are spaced apart at an equidistance from each other by a distance D and the axes of said columns are spaced apart at an equidistance from each other by said distance D, and wherein the lowermost portion of each of said magnetic members has a width which is equal to said distance D.

15. A wave absorber as claimed in claim 14, wherein the number of said plurality of portions of each of said magnetic members is two, and wherein the width of the uppermost portion is between 65% and 85% of the width of the lowermost portion.

16. A wave absorber as claimed in claim 14, wherein the number of said plurality of portions of each of said magnetic members is three, and wherein the width of the intermediate portion is between 65% and 85% of the width of the lowermost portion and the width of the uppermost portion is between 35% and 65% of the width of the lowermost portion.

* * * * *